US005538839A

United States Patent [19]

Abe et al.

[11] Patent Number: 5,538,839

[45] Date of Patent: Jul. 23, 1996

[54] SILVER HALIDE COLOR PHOTOGRAPHIC MATERIAL

[75] Inventors: Ryuji Abe; Shinsuke Bando, both of Kanagawa, Japan

[73] Assignee: Fuji Photo Film Co., Ltd., Kanagawa, Japan

[21] Appl. No.: 455,445

[22] Filed: May 31, 1995

Related U.S. Application Data

[62] Division of Ser. No. 194,318, Feb. 10, 1994.

[30] Foreign Application Priority Data

Feb. 10, 1993 [JP] Japan ..... 5-22810

[51] Int. Cl.[6] ..... G03C 1/46

[52] U.S. Cl. ..... 430/506; 430/567; 430/604; 430/605; 430/503

[58] Field of Search ..... 430/503, 506, 430/567, 604, 605, 435, 379

[56] References Cited

U.S. PATENT DOCUMENTS

| | | | |
|---|---|---|---|
| 4,301,242 | 11/1991 | Patzold et al. . | |
| 4,670,375 | 6/1987 | Michiue et al. | 430/506 |
| 4,792,518 | 12/1988 | Kuwashima et al. | 430/506 |
| 5,037,733 | 8/1991 | Goda | 430/611 |
| 5,156,946 | 10/1992 | Nagaoka et al. | 430/567 |
| 5,278,041 | 1/1994 | Murakami et al. | 430/567 |

FOREIGN PATENT DOCUMENTS

| | | |
|---|---|---|
| 80631 | 8/1983 | European Pat. Off. . |
| 0106705 | 4/1984 | European Pat. Off. . |
| 0399342 | 11/1990 | European Pat. Off. . |
| 0444506 | 9/1991 | European Pat. Off. . |
| 3529375 | 2/1986 | Germany . |
| 3-128337 | 11/1986 | Japan . |
| 63-91658 | 4/1988 | Japan . |
| 1-198753 | 8/1989 | Japan . |
| 3-215853 | 1/1990 | Japan . |
| 3-158847 | 7/1991 | Japan . |

*Primary Examiner*—Geraldine Letscher
*Attorney, Agent, or Firm*—Sughrue, Mion, Zinn, Macpeak & Seas

[57] ABSTRACT

A silver halide photographic material comprising a support having coated thereon at least one blue-sensitive layer containing a yellow coupler, at least one green-sensitive layer containing a magenta coupler and at least one red-sensitive layer containing a cyan coupler, wherein on each of the characteristic curves of yellow, magenta and cyan of the silver halide photographic material, 1) the maximum density is not less than 3.0 and the density obtained by subtracting the density of the support from the minimum density is not more than 0.1, 2) the average value of point gamma at various points in the exposure region corresponding to a density value of from not less than 0.5 to less than 1.5 is from not less than 0.85 to not more than 1.15 and the fluctuation width thereof is within ±15% of the average value of point gamma in the exposure region, and 3) the average value of point gamma at various points in the exposure region corresponding to a density value of from not less than 1.5 to that 0.3 less than the maximum density is from not less than 1.0 to not more than 1.6 and the fluctuation width thereof is within ±15% of the average value of point gamma in the exposure region. The silver halide color photographic material exhibits an excellent tone and color reproducibility with respect to an original.

5 Claims, No Drawings

SILVER HALIDE COLOR PHOTOGRAPHIC MATERIAL

This is a divisional of application Ser. No. 08/194,318, filed Feb. 10, 1994, allowed.

FIELD OF THE INVENTION

The present invention relates to a silver halide color photographic material, and more particularly to a silver halide color photographic material with an excellent tone reproducibility suitable for the duplication of a positive original.

BACKGROUND OF THE INVENTION

Color photographic light-sensitive materials which are now widespread fall into two main groups, i.e., color photographic light-sensitive materials for picture taking such as color negative film, color reversal film and color instant film and color photographic light-sensitive materials for printing the recorded image for observation such as color paper, reversal paper and display film. Among these color photographic light-sensitive materials for picture taking, positive type photographic light-sensitive martials such as color reversal film and instant film are double-purpose photographic light-sensitive materials which can be put into use for picture taking as well as observation. Photographic light-sensitive materials only for picture taking cannot make the picture taken observable without any corresponding printing materials. Thus, these photographic light-sensitive materials for picture taking essentially need the subsequent use of such printing materials. For the foregoing double-purpose photographic light-sensitive materials as well, printing materials (duplicating materials) are required in the case where it is desired to prevent the original from being damaged, e.g., in the case where it is stored as a valuable original or processed as a printing original, or in the case where an enlarged duplicate or a plurality of duplicates are needed.

These printing materials can be roughly divided into two groups. Typical examples of these printing materials include color reversal paper or color auto positive paper which makes the printed image observable on reflected light from a reflective support and color duplicating film or display film which makes the printed image observable by means of transmitted light or projected image through a transparent or translucent support. Among these printing materials, the color duplicating film can make the printed image observable by means of transmitted light simultaneously with its original positioned side by side and thus requires quite the same image quality as the original. The color duplicating film is further practically required to provide an image faithfully duplicating the original. That is, the color duplicating film is required to serve as a printing original or a stock photograph which is subject to prolonged storage. However, it is actually very difficult to reproduce quite the same image quality as the original due to the problems of the properties of photographic light-sensitive materials, the performance of printers, the printing technique, etc.

The quality of color images is mainly determined by three factors, i.e., gradation reproducibility, color reproducibility and image quality reproducibility (granularly and sharpness). Among these factors, gradation reproducibility is a factor particularly important to color duplicating film which is desired to provide faithful reproduction.

Heretofore, for tone reproducibility, attempts have been made to provide faithful reproduction without impairing the tone of the original. It is desired to provide faithful reproduction of an original comprising objects ranging from a highlight such as white cloud to a shadow such as dark hair of a person standing in the shade. However, this can be not so easily accomplished. In order to provide better tone reproduction of the original, attempts have been made to make the characteristic curve of photographic light-sensitive materials desirable.

An approach as disclosed in JP-A-61-50135, JP-A-63-128337, JP-A-63-91658, JP-A-63-202739 and JP-A-64-10244 (The term "JP-A" as used herein means an "unexamined published Japanese patent application") is an example of the foregoing attempts. These approaches are intended to meet the foregoing requirements by defining the point gamma value (first order differential value) in a certain density range on the characteristic curve to a predetermined range. However, these approaches are intended mainly for reflective materials and thus are not suitable for transparent materials which provide a color transparency directly through a transparency, to which the present invention is intended to be applied. In particular, these approaches are quite insufficient for color duplicating film, which is often subjected to contact exposure process for image formation.

It has thus been desired to develop a technique for enabling faithful reproduction of tone and color inherent to the original without any problems.

SUMMARY OF THE INVENTION

As can be seen in the foregoing description, an object of the present invention is to provide a color photographic light-sensitive material, particularly duplicating color film, which can provide an excellent reproduction of tone and color of an original. Further, another object of the present invention is to provide a color photographic light-sensitive material which exhibits an excellent tone and color reproducibility in contact exposure process as well. More particularly, a further object of the present invention is to provide a silver halide color photographic material useful as a duplicating material which provides an excellent reproduction of tone ranging from highlight to shadow.

The foregoing objects of the present invention are accomplished with:

(1) a silver halide photographic material comprising a support having coated thereon at least one blue-sensitive layer containing a yellow coupler, at least one green-sensitive layer containing a magenta coupler and at least one red-sensitive layer containing a cyan coupler, wherein on each of the characteristic curves of yellow, magenta and cyan of said silver halide photographic material, 1) the maximum density is not less than 3.0 and the density obtained by subtracting the density of said support from the minimum density is not more than 0.1, 2) the average value of point gamma at various points in the exposure region corresponding to a density value of from not less than 0.5 to less than 1.5 is from not less than 0.85 to not more than 1.15 and the fluctuation width thereof is within ±15% of the average value of point gamma in said exposure region, and 3) the average value of point gamma at various points in the exposure region corresponding to a density value of from not less than 1.5 to that 0.3 less than the maximum density is from not less than 1.0 to not more than 1.6 and the fluctuation width thereof is within ±15% of the average value of point gamma in said exposure region;

(2) the silver halide photographic material according to the above embodiment (1), wherein the average value of point gamma at various points in an exposure region having a density of from not less than 1.5 to that 0.3 less than the maximum density is from not less than 1.1 times to not more than 1.4 times the average value of point gamma at various points in an exposure region having a density of from not less than 0.5 to less than 1.5;

(3) the silver halide photographic material according to the above embodiment (1), wherein said blue-sensitive layer, green-sensitive layer and red-sensitive layer each consists of a plurality of silver halide emulsion layers having substantially the same color sensitivity and different sensitivities;

(4) the silver halide photographic material according to the above embodiment (3), wherein the number of silver halide emulsion layers belonging to the same color sensitivity layer and having different sensitivities is not less than 3;

(5) the silver halide photographic material according to the above embodiment (3), which comprises a monodisperse silver halide emulsion in the lowest sensitivity layer in at least one color-sensitive layer;

(6) the silver halide photographic material according to the above embodiment (3), which comprises, in the lowest sensitivity emulsion layer and/or the second lowest emulsion layer in the silver halide emulsion layers constituting said at least one color-sensitive layer, a silver halide emulsion which is prepared by adding a compound represented by the following formula in an amount of $10^{-4}$ mol per mol of silver halide before the completion of chemical sensitization:

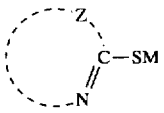

(I)

wherein M represents a hydrogen atom, an alkali metal atom, an ammonium group or a protective group for a mercapto group; and Z represents a nonmetallic atom group necessary for the formation of a heterocyclic ring which may contain substituents or condensed;

(7) the silver halide photographic material according to the above embodiment (6), wherein said compound to be added is represented by the following formula:

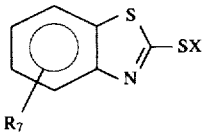

(II)

wherein X represents a hydrogen atom or an alkali metal atom; and $R_7$ represents a hydrogen atom, a halogen atom or a $C_{1-5}$ alkyl group;

(8) a silver halide photographic material comprising a support having coated thereon at least one blue-sensitive layer containing a yellow coupler, at least one green-sensitive layer containing a magenta coupler and at least one red-sensitive layer containing a cyan coupler, wherein on each of the characteristic curves of yellow, magenta and cyan of said silver halide photographic material, 1) the average value of point gamma at various points in the exposure region corresponding to a density value of from not less than 0.5 to less than 1.5 is from not less than 0.85 to not more than 1.15 and the fluctuation width thereof is within ±15% of the average value of point gamma in said exposure region, and 2) the average value of point gamma at various points in the exposure region corresponding to a density value of from not less than 1.5 to that 0.3 less than the maximum density is from not less than 1.0 to not more than 1.6 and the fluctuation width thereof is within ±15% of the average value of point gamma in said exposure region, and there are contained in at least one silver halide emulsion layer belonging to at least one color-sensitive layer two silver halide emulsions having the relationship between the average grain diameter and the sensitivity represented by the following inequality:

$$0.3 \leqq log(S1/S2) - 2log(X1/X2) \leqq 2.0$$

wherein S1 and S2 represent the sensitivity of Emulsion 1 and Emulsion 2 as calculated in terms of the reciprocal of exposure, respectively; and X1 and X2 represent the average grain diameter of Emulsion 1 and Emulsion 2, respectively;

(9) the silver halide photographic material according to the above embodiment (8), wherein a rhodium salt is added during the formation of grains for one of said two silver halide emulsions contained in the same silver halide emulsion layer whichever has a lower sensitivity;

(10) the silver halide photographic material according to any one of the above embodiments (1) to (9), which is of transmission type;

(11) the silver halide photographic material according to any one of the above embodiments (6) to (9), which is processed with a developer containing a thiocyanate; and

(12) the silver halide photographic material according to any one of the above embodiments (1) to (11), which is of color reversal type.

DETAILED DESCRIPTION OF THE INVENTION

The present invention will be further described hereinafter.

The term "characteristic curve" as used herein means a so-called "D-log E curve", which is further discussed in, e.g., T. H. James, "The Theory of the Photographic Process", 4th ed., pp. 501–509 in detail. The maximum and minimum value on D axis of the characteristic curve are defined as Dmax and Dmin, respectively. Point gamma is first order differential value of the "characteristic curve", which is also discussed in, e.g., T. H. James, "The Theory of the Photographic Process", 4th ed., p. 502 and can be represented by the following equation:

$$\text{Point gamma} = dD/dlogE$$

The characteristic curve as defined herein is determined in accordance with the following testing method:

(1) Test Conditions

The test is conducted at a temperature of 23°±5° C. and a relative humidity of 50±20% in a fully dark room. The photographic light-sensitive material to be tested is allowed to stand under these conditions for 1 hour before use.

(2) Exposure Conditions

The relative spectral energy distribution of reference light on the exposure surface is shown in the table below. The change in the illumination on the exposure surface is conducted by means of an optical wedge. In any portion of the optical wedge having a spectral transmission density variation of 360 nm to 700 run, the region having a spectral transmission density variation of less than 400 nm accounts for not more than 10% thereof and the region having a spectral transmission density variation of not less than 400 nm accounts for not more than 5% thereof. The exposure time is from 1/10 to 10 seconds.

TABLE

| Relative spectral energy distribution of reference light on the exposure surface | |
|---|---|
| Wavelength (nm) | Relative spectral energy ([3]) |
| 360 | 0 |
| 370 | 1 |
| 380 | 3 |
| 390 | 7 |
| 400 | 12 |
| 410 | 17 |
| 420 | 21 |
| 430 | 26 |
| 440 | 32 |
| 450 | 36 |
| 460 | 42 |
| 470 | 47 |
| 480 | 52 |
| 490 | 58 |
| 500 | 63 |
| 510 | 70 |
| 520 | 76 |
| 530 | 81 |
| 540 | 88 |
| 550 | 94 |
| 560 | 100 |
| 570 | 105 |
| 580 | 111 |
| 590 | 115 |
| 600 | 121 |
| 610 | 126 |
| 620 | 129 |
| 630 | 135 |
| 640 | 139 |
| 650 | 144 |
| 660 | 147 |
| 670 | 149 |
| 680 | 152 |
| 690 | 157 |
| 700 | 159 |

Note ([3]): value determined relative to that at 560 nm as 100

(3) Processing Conditions

The photographic light-sensitive material to be tested is kept at a temperature of 23°±5° C. and a relative humidity of 50±20% during the period between exposure and development. Development is completed in 30 minutes to 6 hours after exposure. Development is effected in the following steps:

| Processing step | Time | Temp. | Tank capacity | Replenishment rate |
|---|---|---|---|---|
| 1st | 6 min. | 38° C. | 12 l | 2,200 ml/m$^2$ |

-continued

| Processing step | Time | Temp. | Tank capacity | Replenishment rate |
|---|---|---|---|---|
| Development | | | | |
| 1st Washing | 2 min. | 38° C. | 4 l | 7,500 ml/m$^2$ |
| Reversal | 2 min. | 38° C. | 4 l | 1,100 ml/m$^2$ |
| Color development | 6 min. | 38° C. | 12 l | 2,200 ml/m$^2$ |
| Prebleach | 2 min. | 38° C. | 4 l | 1,100 ml/m$^2$ |
| Bleach | 6 min. | 38° C. | 12 l | 220 ml/m$^2$ |
| Fixing | 4 min. | 38° C. | 8 l | 1,100 ml/m$^2$ |
| 2nd Washing | 4 min. | 38° C. | 8 l | 7,500 ml/m$^2$ |
| Final rinsing | 1 min. | 25° C. | 2 l | 1,100 ml/m$^2$ |

The composition of the processing solutions used at the various steps will be described hereinafter.

| [1st Developer] | [Running solution] | [Replenisher] |
|---|---|---|
| Pentasodium Nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Potassium hydroquinone monosulfonate | 20 g | 20 g |
| Potassium carbonate | 15 g | 20 g |
| Sodium bicarbonate | 12 g | 15 g |
| 1-Phenyl-4-methyl-4-hydroxy-methyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |

The pH value was adjusted with sulfuric acid or potassium hydroxide.

| [Reversal solution] | [Running solution] | [Replenisher] |
|---|---|---|
| Pentasodium nitrilo-N,N,N-trimethylenephosphonate | 3.0 g | Same as running solution |
| Stannous chloride dihydrate | 1.0 g | Same as running solution |
| p-Aminophenol | 0.1 g | Same as running solution |
| Sodium hydroxide | 8 g | Same as running solution |
| Glacial acetic acid | 15 ml | Same as running solution |
| Water to make | 1,000 ml | Same as running solution |
| pH | 6.00 | Same as running solution |

The pH value was adjusted with acetic acid or sodium hydroxide.

| [Color developer] | [Running solution] | [Replenisher] |
|---|---|---|
| Pentasodium nitrilo-N,N,N- | 2.0 g | 2.0 g |

-continued

| [Color developer] | [Running solution] | [Replenisher] |
|---|---|---|
| trimethylenephosphonate | | |
| Sodium sulfite | 7.0 g | 7.0 g |
| Trisodium phosphate dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfonamidoethyl)-3-methyl-4-aminoaniline ½ sulfate monohydrate | 11 g | 11 g |
| 3,6-Dithiaoctane-1,8-diol | 1.0 g | 1.0 g |
| Water to make | 1,000 ml | 1,000 ml |
| pH | 11.80 | 12.00 |

The pH value was adjusted with sulfuric acid or potassium hydroxide.

| [Pre-bleach bath] | [Running solution] | [Replenisher] |
|---|---|---|
| Disodium ethylenediamine-tetraacetate dihydrate | 8.0 g | 8.0 g |
| Sodium sulfite | 6.0 g | 8.0 g |
| 1-Thioglycerol | 0.4 g | 0.4 g |
| Formaldehyde-sodium bisulfite adduct | 30 g | 35 g |
| Water to make | 1,000 ml | 1,000 ml |
| pH | 6.30 | 6.10 |

The pH value was adjusted with acetic acid or sodium hydroxide.

| [Bleaching solution] | [Running solution] | [Replenisher] |
|---|---|---|
| Disodium ethylenediamine-tetraacetate dihydrate | 2.0 g | 4.0 g |
| Ammonium ethylenediamine-tetraacetato ferrate dihydrate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |

The pH value was adjusted with nitric acid or sodium hydroxide.

| [Fixing solution] | [Running solution] | [Replenisher] |
|---|---|---|
| Ammonium thiosulfate | 80 g | Same as running solution |
| Sodium sulfite | 5.0 g | Same as running solution |
| Sodium bisulfite | 5.0 g | Same as running solution |
| Water to make | 1,000 ml | Same as running solution |
| pH | 6.60 | Same as running solution |

The pH value was adjusted with acetic acid or aqueous ammonia.

| [Final rinsing solution] | [Running solution] | [Replenisher] |
|---|---|---|
| 1,2-Benzothiazoline-3-one | 0.02 g | 0.03 g |
| Polyoxyethylene-p-monononylphenyl ether (average polymerization degree: 10) | 0.3 g | 0.3 g |
| Polymaleic acid (average molecular weight: 2,000) | 0.1 g | 0.15 g |
| Water to make | 1,000 ml | 1,000 ml |
| pH | 7.0 | 7.0 |

(4) Measurement of Density

The density is represented by $\log_{10}(\phi_0/\phi)$ wherein $\phi_0$ is an illumination luminous flux for the measurement of density, and $\phi$ is a transmitted luminous flux passing through the portion to be measured. The density measurement is effected under geometrical conditions such that the illumination luminous flux is a parallel luminous flux in the direction of normal and luminous flux which has been transmitted and extended into semi-space is entirely used as the transmitted luminous flux. If other measurement methods are used, correction is made with respect to a reference density fragment. In the measurement, the emulsion film side is opposed to the light-receiving apparatus side. Three color densities are determined using R, G and B status AA filters.

As mentioned above, the specimen is exposed to light, developed, and then measured for density. R, G and B densities thus obtained are plotted against the common logarithm (log E) of the exposure to determine the density function curve.

The terminology "average value of point gamma" as used herein is meant to indicate a value calculated as follows. The average value over a density range from a to b is given by the following equation:

$$\text{Average value of point gamma} = \int_a^b \frac{1}{(b-a)} \left( \frac{dD}{d\log E} \right) d\log E$$

The terminology "fluctuation width of point gamma" as used herein is meant to indicate a value determined as follows. Assuming that the maximum and minimum values of point gamma in a density range from a to b are γmx and γmn, respectively, it is given by the following equation:

$$\text{Fluctuation width of point gamma} = \frac{\gamma mx - \gamma mn}{\text{average value of point gamma}} \times 100$$

The photographic light-sensitive material according to the present invention exhibits yellow, magenta and cyan densities of 3.0 or more at maximum. Preferably, the maximum yellow and magenta densities are 3.2 or more, and the maximum cyan density is 3.0 or more. More preferably, the maximum yellow and magenta densities are 3.3 or more, and the maximum cyan density is 3.0 or more. Similarly, the density obtained by subtracting the density of the support from the minimum density is 0.1 or less. The density obtained by subtracting the density of the support from the minimum density is preferably low. Preferably, it is 0.08 or less, more preferably 0.06 or less.

The average value of point gamma at various points in the exposure region corresponding to a density value of from not less than 0.5 to less than 1.5 is from not less than 0.85 to not more than 1.15 and the fluctuation width thereof is within ±15% of the average value of point gamma in the exposure region, and the average value of point gamma at various points in the exposure region corresponding to a density value of from not less than 1.5 to that 0.3 less than the maximum density is from not less than 1.0 to not more than 1.6 and the fluctuation width thereof is within ±15% of the average value of point gamma in the exposure region. Preferably, the average value of point gamma at various points in the exposure region corresponding to a density value of from not less than 0.5 to less than 1.5 is from not less than 0.90 to not more than 1.10 and the fluctuation width thereof is within ±10% of the average value of point gamma in the exposure region, and the average value of point gamma at various points in the exposure region corresponding to a density value of from not less than 1.5 to that 0.3 less than the maximum density is from not less than 1.05 to not more than 1.50 and the fluctuation width thereof is within ±10% of the average value of point gamma in the exposure region. More preferably, the average value of point gamma at various points in the exposure region corresponding to a density value of from not less than 0.5 to less than 1.5 is from not less than 0.95 to not more than 1.05 and the fluctuation width thereof is within ±8% of the average value of point gamma in the exposure region, and the average value of point gamma at various points in the exposure region corresponding to a density value of from not less than 1.5 to that 0.3 less than the maximum density is from not less than 1.10 to not more than 1.40 and the fluctuation width thereof is within ±8% of the average value of point gamma in the exposure region.

In the present invention, the average value of point gamma at various points in an exposure region having a density of from not less than 1.5 to that 0.3 less than the maximum density is from not less than 1.0 time to not more than 1.4 times, preferably from not less than 1.1 times to not more than 1.3 times the average value of point gamma at various points in an exposure region having a density of from not less than 0.5 to less than 1.5.

In order to attain the foregoing photographic properties, the blue-sensitive layer, green-sensitive layer and red-sensitive layer each preferably consists of a plurality of substantially the same silver halide emulsion layers having different sensitivities. Each light-sensitive layer preferably consists of two or more layers, more preferably 3 or more layers.

As the lowest sensitivity emulsion there is preferably used a monodisperse emulsion. The term "monodisperse emulsion" as used herein means an emulsion having a grain size distribution such that the proportion of the dispersion of the size of silver halide grains to the average grain size is as defined below. An emulsion of light-sensitive silver halide grains having a nearly uniform crystal form and a small grain size dispersion has a nearly normal grain size distribution. Thus, the standard deviation of grain size can be easily determined and can be defined by the following relationship:

(Standard deviation/average grain diameter)×100 (%)

The foregoing emulsion to be used in the present invention has a monodispersibility of 25%, preferably 20%, more preferably 15% or less.

The present invention can be remarkably accomplished by using, in the lowest sensitivity emulsion layer and/or the second lowest emulsion layer in the silver halide emulsion layers constituting the at least one color-sensitive layer, a silver halide emulsion which is prepared by adding a compound represented by the following formula in an amount of not less than $10^{-4}$ mol per mol of silver halide before the completion of chemical sensitization:

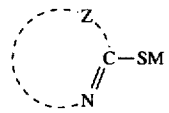

(I)

wherein M represents a hydrogen atom, an alkali metal atom, an ammonium group or a protective group for a mercapto group; and Z represents a nonmetallic atom group necessary for the formation of a heterocyclic ring which may contain substituents or condensed. An examples of the protective group for the mercapto group represented by M is a group which undergoes cleavage with an alkali to form a mercapto group. Specific examples of such a protective group include an acyl group, an alkoxycarbonyl group and an alkylsulfonyl group.

The heterocyclic group containing Z, N and C may contain a carbon atom, a nitrogen atom, an oxygen atom, a sulfur atom, a selenium atom, etc. as constituent atoms. The heterocyclic group is preferably a 5- or 6-membered ring. Specific examples of such a heterocyclic group include imidazole, benzoimidazole, naphthoimidazole, thiazole, thiazoline, benzothiazole, naphthothiazole, oxazole, benzoxazole, naphthoxazole, selenazole, benzoselenazole, naphthoselenazole, triazole, benzotriazole, tetrazole, oxadiazole, thiadiazole, pyridine, pyrimidine, triazine, purine and azaindene.

Examples of substituents which may be present on these heterocyclic groups include a halogen atom, a hydroxy group, an amino group, a nitro group, a mercapto group, a carboxy group and a salt thereof, a sulfo group and a salt thereof, an alkyl group, an alkoxy group, an aryl group, an aryloxy group, an alkylthio group, an arylthio group, an acylamino group, a sulfonamido group, a carbamoyl group and a sulfamoyl group.

Particularly preferred among the compounds represented by the formula (I) are those represented by the following formulae (Ia), (Ib) and (Ic):

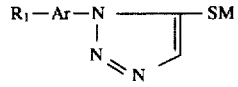

(Ia)

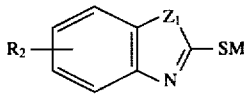

(Ib)

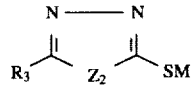

(Ic)

wherein M is as defined in the formula (I).

In the formula (Ia), Ar represents a phenyl group, a naphthyl group or a cycloalkyl group, and $R_1$ represents a hydrogen atom or a substituent on Ar. In the formula (Ib), $Z_1$ represents an oxygen atom, a sulfur atom, a selenium atom or —NH—, and $R_2$represents a hydrogen atom or a substituent. In the formula (Ic), $Z_2$ represents an oxygen atom, a sulfur atom, a selenium atom or —$NR_4$— (in which $R_4$ represents a hydrogen atom, an alkyl group, an alkenyl group, a cycloalkyl group, an aryl group, an aralkyl group, —$COR_5$, —$SO_2R_5$, —$NHCOR_6$ or —$NHSO_2R_6$, wherein $R_5$ represents an alkyl group, an aryl group, an aralkyl group or an amino group and $R_6$ represents an alkyl group, a cycloalkyl group, an aryl group or an aralkyl group), and $R_3$ represents a hydrogen atom, an alkyl group, an alkenyl group, a cycloalkyl group, an aryl group, an aralkyl group, a heterocyclic group or an amino group.

Examples of substituents represented by $R_1$ in the formula (Ia) or of substituents represented by $R_2$ in the formula (Ib) include a halogen atom (e.g., fluorine, chlorine, bromine), a hydroxy group, an amino group, a substituted amino group (e.g., dimethylamino), a nitro group, a carboxy group and a salt thereof, a sulfo group and a salt thereof, an alkyl group (e.g., methyl, ethyl, propyl, isopropyl, hydroxyethyl), an alkoxy group (e.g., methoxy, ethoxy, butoxy), an aryl group (e.g., phenyl, tolyl, anisyl, chlorophenyl, 1-naphthyl, 2-naphthyl), an aryloxy group, an alkylthio group (e.g., methylthio, ethylthio), an arylthio group, an acylamino group (e.g., acetylamino, propionylamino, benzoylamino), a sulfonamido group (e.g., benzenesulfonamido), a carbamoyl group (e.g., dimethylcarbamoyl, methylcarbamoyl, phenylcarbamoyl), a sulfamoyl group (e.g., methylsulfamoyl, ethylsulfamoyl) and a ureido group (e.g., N-methylcarbamoylamino).

Specific examples of the compound represented by the formula (I) will be given below, but the present invention should not be construed as being limited thereto.

(I-1)

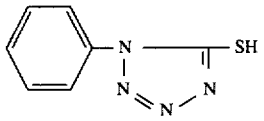

(I-2)

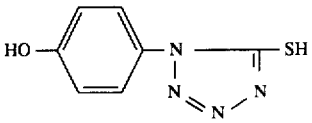

(I-3)

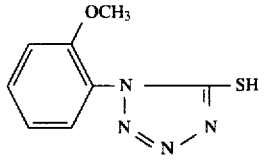

(I-4)

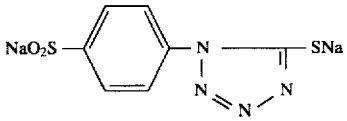

(I-5)

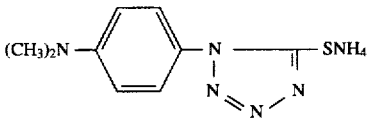

(I-6)

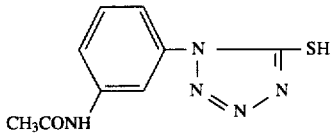

(I-7)

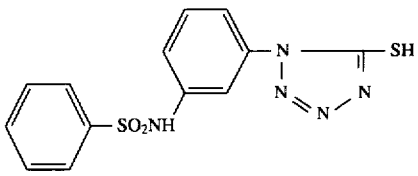

-continued (I-8)

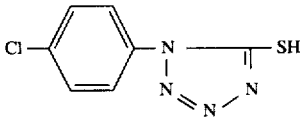

(I-9)

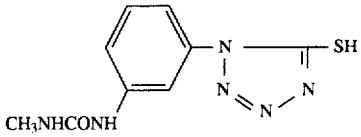

(I-10)

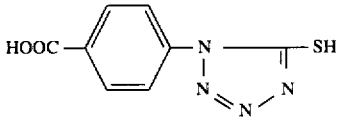

(I-11)

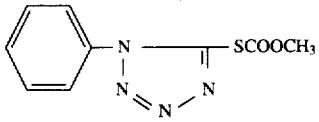

(I-12)

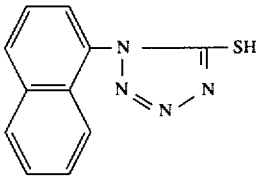

(I-13)

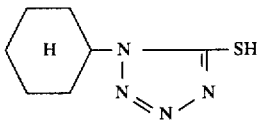

(I-14)

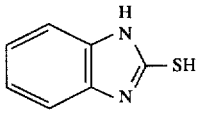

(I-15)

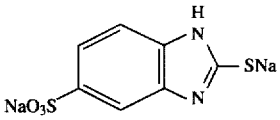

(I-16)

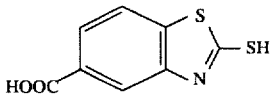

(I-17)

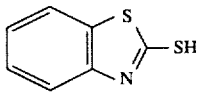

(I-18)

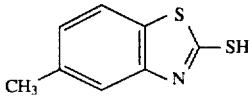

(I-19)

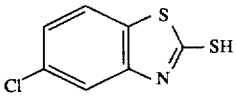

(I-20)

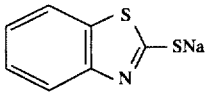

-continued
(I-21)
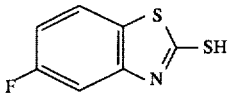
(I-22)
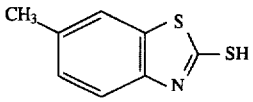
(I-23)
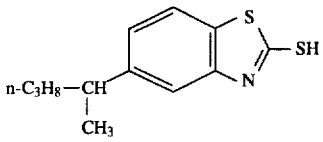
(I-24)
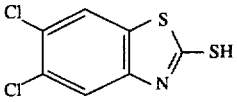
(I-25)
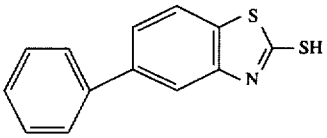
(I-26)
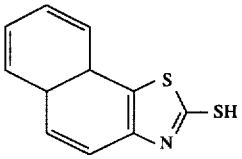
(I-27)
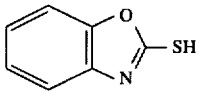
(I-28)
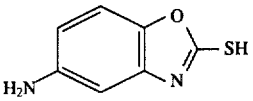
(I-29)
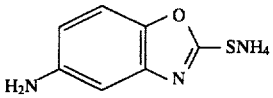
(I-30)
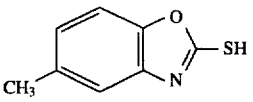
(I-31)
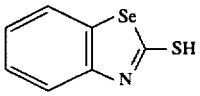
(I-32)
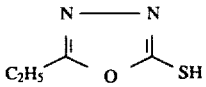
(I-33)
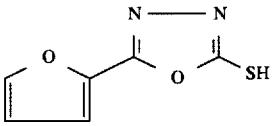
-continued
(I-34)
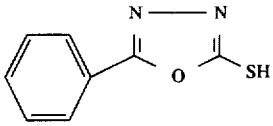
(I-35)
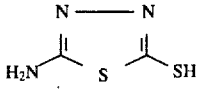
(I-36)
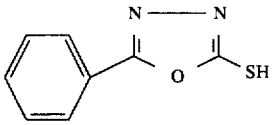
(I-37)
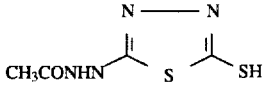
(I-38)
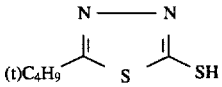
(I-39)
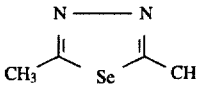
(I-40)
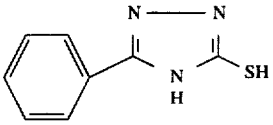
(I-41)
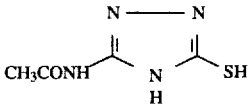
(I-42)
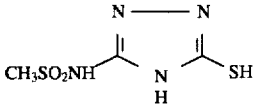
(I-43)
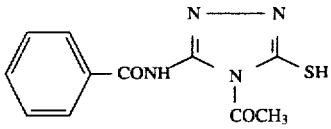
(I-44)
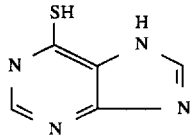
(I-45)
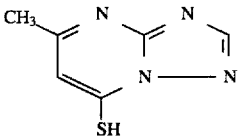
The synthesis of the compound represented by the formula (I) can be easily accomplished by known methods. For example, synthesis methods as described in U.S. Pat. Nos. 2,403,927 and 3,376,310, JP-A-55-59463 and "Journal of the Chemical Society", page 4237, (1952) can be used.

Some of the compounds represented by the formula (I) can be commercially available.

The compound represented by the formula (I) may be incorporated in any emulsion layers in the photographic light-sensitive material in the form of solution in water or an organic solvent having an affinity for water (e.g., methanol, acetone) or in a weak alkali or weak acid. Preferred among the compounds represented by the formulae (Ia) to (Ic) is the compound represented by the formula (Ib).

The silver halide grains according to the present invention are more preferably subjected to chemical sensitization in the presence of a compound represented by the formula (II) (hereinafter referred to as "Compound (II)"), with Compound (II) being preferred among the compounds represented by the formula (Ib). That is, the silver halide emulsion according to the present invention comprises at least one Compound (II) present therein during chemical sensitization. The addition of Compound (II) may be effected during ordinary emulsion preparation step, grain formation step, subsequent desalting step or shortly before or during chemical sensitization of re-dispersed silver halide grains. If Compound (II) is added during the growth of grains, the addition is preferably effected after the addition of 50%, more preferably 80% of the total amount of silver nitrate.

The amount of Compound (II) to be added is preferably from $1\times10^{-4}$ mol to $1\times10^{-2}$ mol per mol of silver halide in the emulsion. If Compound (II) is added during the formation of grains, it is preferably added more, e.g., about 5 times more than added after desalting. The formula (II) will be further described hereinafter.

In the formula (II), X represents a hydrogen atom or an alkali metal atom (e.g., lithium, sodium, potassium). X is preferably a hydrogen atom, sodium or potassium, more preferably a hydrogen atom or sodium.

$R_7$ represents a hydrogen atom, a halogen atom (e.g., fluorine, chlorine, bromine) or a $C_{1-5}$ alkyl group. The alkyl group may be substituted. $R_7$ is preferably a hydrogen atom, a fluorine atom, a chlorine atom or a $C_{1-5}$ alkyl group. The number of substituents represented by $R_7$ is preferably 1 or 2. Examples of substituents for the alkyl group represented by $R_7$ include a halogen atom (e.g., fluorine, chlorine, bromine), a hydroxy group, an amino group, a substituted amino group (e.g., dimethylamino), a nitro group, a carboxy group and a salt thereof, a sulfo group and a salt thereof, an alkyl group (e.g., methyl, ethyl, propyl, isopropyl, hydroxyethyl), an alkoxy group (e.g., methoxy, ethoxy, butoxy), an aryl group (e.g., phenyl, tolyl, anisyl, chlorophenyl, 1-naphthyl, 2-naphthyl), an aryloxy group, an alkylthio group (e.g., methylthio, ethylthio), an arylthio group, an acylamino group (e.g., acetylamino, propionylamino, benzoylamino), a sulfonamido group (e.g., benzenesulfonamido), a carbamoyl group (e.g., dimethylcarbamoyl, methylcarbamoyl, phenylcarbamoyl), a sulfamoyl group (e.g., methylsulfamoyl, ethylsulfamoyl) and a ureido group (e.g., N-methylcarbamoylamino).

Specific preferred examples of Compound (II) are (I-17) to (I-24).

The present invention can further exert its effects by using a configuration such that there are contained in at least one silver halide emulsion layer belonging to at least one color-sensitive layer two silver halide emulsions having the relationship between the average grain diameter and the sensitivity represented by the following relationship:

$$0.3 \leqq \log(S1/S2) - 2\log(X1/X2) \leqq 2.0$$

The term (log(S1/S2)−2log(X1/X2)) is preferably from not less than 0.4 to not more than 1.5, more preferably from not less than 0.5 to not more than 1.2.

The present invention can further exert its effects by adding a rhodium salt during the formation of grains for one of the two silver halide emulsions contained in the same silver halide emulsion layer whichever has a lower sensitivity. The amount of such a rhodium salt to be added depends on the grain diameter of silver halide gains, the timing at which it is added, the desired sensitivity, etc. and is preferably from $10^{-10}$ to $10^{-3}$ mol, more preferably from $10^{-9}$ to $10^{-4}$ mol, particularly from $10^{-8}$ to $10^{-5}$ mol per mol of silver halide. A typical example of such a rhodium salt is $K_3RhBrCl_{6-n}$ (in which n represents an integer satisfying the relationship $0 \leqq n \leqq 6$).

The photographic light-sensitive material of the present invention can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the silver halide photographic material of the present invention comprises at least one light-sensitive layer consisting of a plurality of silver halide emulsion layers having substantially the same color sensitivity and different light sensitivities on a support. The light-sensitive layers are unit light-sensitive layers having a color sensitivity to any of blue light, green light and red light. In the multi-layer silver halide color photographic material, these unit light-sensitive layers are normally arranged in the order of red-sensitive layer, green-sensitive layer and blue-sensitive layer as viewed from the support. However, the order of arrangement can be optionally reversed depending on the purpose of application. Alternatively, two unit light-sensitive layers having the same color sensitivity can be arranged with at least one unit light-sensitive layer(s) having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as described in JP-A-61-43748, JP-A-59-113438, JP-A-59-113440, JP-A-61-20037 and JP-A-61-20038.

These interlayers can further comprise a color stain preventing agent as commonly used.

The plurality of silver halide emulsion layers constituting each unit light-sensitive layer can be preferably in a two-layer structure, i.e., high sensitivity emulsion layer and low sensitivity emulsion layer, as described in West German Patent 1,121,470 and British Patent 923,045. In general, these layers are preferably arranged in such an order that the light sensitivity becomes lower towards the support. Furthermore, a light-insensitive layer can be provided between these silver halide emulsion layers. As described in JP-A-57-112751, JP-A-62-200350, JP-A-62-206541 and JP-A-62-206543, a low sensitivity emulsion layer can be provided remote from the support while a high sensitivity emulsion layer can be provided nearer to the support.

In an embodiment of such an arrangement, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH) and a low sensitivity red-sensitive layer (RL) can be arranged in this order from the side remotest from the support. In another embodiment, BH, BL, GL, GH, RH and RL can be arranged in this order from the side remotest from the support. In a further embodiment, BH, BL, GH, GL, RL and RH can be arranged in this order from the side remotest from the support.

As described in JP-B-55-34932 (The term "JP-B" as used herein means an "examined Japanese patent publication"), blue-sensitive layer, GH, RH, GL and RL can be arranged in this order from the side remotest from the support. Alternatively, as described in JP-A-56-25738 and JP-A-62-63936, a blue-sensitive layer, GL, RL, GH and RH can be arranged in this order from the side remotest from the support.

As described in JP-B-49-15495, a layer arrangement can be used such that the uppermost layer is a silver halide emulsion layer having the highest sensitivity, the middle layer is a silver halide emulsion layer having a sensitivity lower than that of the uppermost layer, and the lowermost layer is a silver halide emulsion layer having a sensitivity lower than that of the middle layer. In such a layer arrangement, the light sensitivity becomes lower towards the support. Even if the layer structure comprises three layers having different light sensitivities, a middle sensitivity emulsion layer, a high sensitivity emulsion layer and a low sensitivity emulsion layer can be arranged in this order from the side remote from the support in a color-sensitive layer as described in JP-A-59-202464.

Alternatively, a high sensitivity emulsion layer, a low sensitivity emulsion layer and a middle sensitivity emulsion layer or a low sensitivity emulsion layer, a middle sensitivity emulsion layer and a high sensitivity emulsion layer may be arranged in this order from the side remote from the support. In the case of four or more layer structure, too, the arrangement of layers may be similarly altered.

In order to improve color reproducibility, a donor layer (CL) for an interimage effect having a different spectral sensitivity distribution from the main light-sensitive layers such as BL, GL and RL is preferably provided adjacent or close to these main layers as described in U.S. Pat. Nos. 4,663,271, 4,705,744 and 4,707,436 and JP-A-62-160448 and JP-A-63-89850.

As described above, various layer structures and arrangements can be selected depending on the purpose of light-sensitive material. A suitable silver halide to be incorporated in the photographic emulsion layer in the photographic light-sensitive material to be used in the present invention is silver bromoiodide, silver chloroiodide or silver bromochloroiodide containing silver iodide in an amount of about 30 mole % or less. Particularly suitable is silver bromoiodide or silver chloroiodide each containing silver iodide in an amount of about 1 mole % to about 8 mole %.

Silver halide grains in the emulsions for use in the present invention may be grains having a regular crystal form, such as cube, octahedron and tetradecahedron, or those having an irregular crystal form such as sphere and plate, those having a crystal defect such as twinning plane, or those having a composite of these crystal forms.

The silver halide grains may be either fine grains of about 0.1 μm or smaller in diameter or larger grains having a projected area diameter of up to about 10 μm. The emulsion may be either a monodisperse emulsion or a polydisperse emulsion.

The preparation of the silver halide photographic emulsion which can be used in the present invention can be accomplished by any suitable method as described in Research Disclosure No. 17643 (December 1978), pp. 22–23, "I. Emulsion Preparation and Types", No. 18716 (November 1979), page 648, and No. 307105 (November 1989), pp. 863–865, P. Glafkides, "Chimie et Physique Photographique", Paul Montel (1967), G. F. Duffin, "Photographic Emulsion Chemistry", Focal Press, (1966), and V. L. Zelikman et al., "Making and Coating Photographic Emulsion", Focal Press, (1964).

Furthermore, monodisperse emulsions as described in U.S. Pat. Nos. 3,574,628 and 3,655,394 and British Patent 1,413,748 can be preferably used in the present invention.

Tablar grains having an aspect ratio of about 2 or more can be used in the present invention. The preparation of such tabular grains can be easily accomplished by any suitable method as described in Gutoff, "Photographic Science and Engineering", vol. 14, pp. 24.8–257, (1970), U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may have fused thereto a silver halide having a different halogen composition or a compound other than silver halide, e.g., silver thiocyanate, lead oxide, etc. by an epitaxial junction. Mixtures of grains having various crystal forms may also be used.

The above mentioned emulsion may be of the surface latent image type in which latent images are mainly formed on the surface of grains the internal latent image type in which latent images are mainly formed inside grains or the type in which latent images are formed both on the surface and inside grains. The emulsion needs to be a negative type emulsion. If the emulsion is of the internal latent image type, it may be a core/shell type internal latent image emulsion as disclosed in JP-A-63-264740. A process for the preparation of such a core/shell type internal latent image emulsion is described in JP-A-59-133542. In this emulsion, the thickness of the shell depends on development process, etc. and is preferably in the range of 3 to 100 nm, particularly 5 to 20 nm.

The silver halide emulsion to be used in the present invention is normally subjected to physical ripening, chemical ripening and spectral sensitization. Additives to be used in these steps are described in Research Disclosure Nos. 17643, 18716 and 307105 as tabulated below.

In the light-sensitive material of the present invention, two or more kinds of light-sensitive silver halide emulsions which are different in at least one of grain size, grain size distribution, halogen composition, grain shape and sensitivity may be incorporated in the same layer in admixture.

Surface-fogged silver halide grains as described in U.S. Pat. No. 4,082,553, internally-fogged silver halide grains as described in U.S. Pat. No. 4,626,498 and JP-A-59-214852, or colloidal silver may be preferably incorporated in a light-sensitive silver halide emulsion layer and/or substantially light-insensitive hydrophilic colloidal layer. The term "internally- or surface-fogged silver halide grains" as used herein means "silver halide grains which can be uniformly (nonimagewise) developed regardless of whether they were present in the exposed portion or unexposed portion on the light-sensitive material". Processes for the preparation of internally- or surface-fogged silver halide grains are described in U.S. Pat. No. 4,626,498 and JP-A-59-214852.

Silver halides forming the core of internally-fogged core/shell type silver halide grains may have the same or different halogen compositions. Internally- or surface-fogged silver halide grains may comprise any of silver chloride, silver bromochloride, silver bromoiodide and silver bromochloroiodide. The size of these fogged silver halide grains is not specifically limited, and its average grain size is preferably in the range of 0.01 to 0.75 μm, particularly 0.05 to 0.6 μm. The crystal form of these grains is not specifically limited and may be regular. These emulsions may be polydisperse but is preferably monodisperse (silver halide grains at least 95% by weight or number of which are those having grain diameters falling within ±40% from the average grain size).

In the present invention, light-insensitive finely divided silver halide grains are preferably used. Light-insensitive finely divided silver halide grains are silver halide grains which are not exposed to light upon imagewise exposure for taking of dye images so that they are not substantially developed at development process. Preferably, these silver halide grains are not previously fogged.

These finely divided silver halide grains have a silver bromide content of 0 to 100 mole % and may optionally contain silver chloride and/or silver iodide, preferably 0.5 to 10 mole % of silver iodide.

These finely divided silver halide grains preferably have an average diameter of 0.01 to 0.5 μm, more preferably 0.02 to 0.2 μm as calculated in terms of diameter of circle having the same area as the projected area of grain.

These finely divided silver halide grains can be prepared in the same manner as ordinary light-sensitive silver halide. In this case, the surface of the silver halide grains needs neither chemically nor spectrally be sensitized. However, prior to the addition of the emulsion to a coating solution, a known stabilizer such as triazole, azaindene, benzothiazolium or mercapto compound and zinc compound is preferably added to the emulsion. Colloidal silver can be preferably incorporated in the layer containing these finely divided silver halide grains.

The coated amount of silver in the light-sensitive material of the present invention is preferably in the range of 6.0 g/m$^2$ or less, most preferably 4.5 g/m$^2$ or less.

Known photographic additives which can be used in the present invention are also described in the above cited three Research Disclosures as tabulated below.

| Kind of additive | RD17643 | RD18716 | RD307105 |
|---|---|---|---|
| 1. Chemical sensitizer | p. 23 | p. 648 right column (RC) | p. 866 |
| 2. Sensitivity increasing agent | | p. 648 right column (RC) | |
| 3. Spectral sensitizer and supersensitizer | pp. 23-24 | p. 648 RC-p. 649 RC | pp. 866–868 |
| 4. Brightening agent | p. 24 | p. 647 RC | p. 868 |
| 5. Antifoggant and stabilizer | pp. 24-25 | p. 649 RC | pp. 868–870 |
| 6. Light absorbent, filter dye, and ultraviolet absorbent | pp. 25-26 | p. 649 RC-p. 650 left column (LC) | p. 873 |
| 7. Stain inhibitor | p. 25 RC | p. 650 LC-RC | p. 872 |
| 8. Dye image stabilizer | p. 25 | p. 650 LC | p. 872 |
| 9. Hardening agent | p. 26 | p. 651 LC | pp. 874–875 |
| 10. Binder | p. 26 | p. 651 LC | pp. 873–874 |
| 11. Plasticizer and lubricant | p. 27 | p. 650 RC | p. 876 |
| 12. Coating aid and surface active agent | pp. 26–27 | p. 650 RC | pp. 875–876 |
| 13. Antistatic agent | p. 27 | p. 650 RC | pp. 876–877 |
| 14. Matting agent | | | pp. 878–879 |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

The light-sensitive material of the present invention preferably comprises a mercapto compound as disclosed in U.S. Pat. Nos. 4,740,454 and 4,788,132, JP-A-62-18539 and JP-A-1-283551.

The light-sensitive material of the present invention preferably comprises a fogging agent, a development accelerator, a silver halide solvent or a compound for releasing precursors thereof as disclosed in JP-A-1-106052 regardless of the amount of developed silver produced by development.

The light-sensitive material of the present invention preferably comprises a dye which has been dispersed by a method as disclosed in Published unexamined International Application No. WO88/04794 and Published unexamined International Application No. 1-502912 or a dye as disclosed in EP317,308A, U.S. Pat. No. 4,420,555 and JP-A-1-259358.

The light-sensitive material of the present invention can comprise various color couplers. Specific examples of the color couplers are described in the patents described in the above cited Research Disclosure No. 17643, VII-C to G and No. 307105, VII-C to G.

Preferred yellow couplers include those described in U.S. Pat. Nos. 3,933,501, 4,022,620, 4,326,024, 4,401,752, 4,248,961, 3,973,968, 4,314,023 and 4,511,649, JP-B-58-10739, British Patents 1,425,020 and 1,476,760, and European Patent 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654 and 4,556,630, European Patent 73,636, JP-A-60-33552, JP-A-60-43659, JP-A-61-72238, JP-A-60-35730, JP-A-55-118034, JP-A-60-185951, Research Disclosure Nos. 24220 (June 1984) and 24230 (June 1984) and Published unexamined International Application No. WO88/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212 and 4,296,199, West German Patent Publication (OLS) No. 3,329,729, European Patents 121,365A and 249,453A and JP-A-61-42658. Further, pyrazoloazole couplers as disclosed in JP-A-64-553, JP-A-64-554, JP-A-64-555 and JP-A-64-556 and imidazole couplers as disclosed in U.S. Pat. No. 4,818,672 can be used.

Typical examples of polymerized dye-forming couplers are described in U.S. Pat. Nos. 3,451,820, 4,080,211, 4,367,282, 4,409,320 and 4,576,910, British Patent 2,102,137 and European Patent 341,188A.

Couplers which form a dye having moderate diffusibility preferably include those described in U.S. Pat. No. 4,366,237, British Patent 2,125,570, European Patent 96,570 and West German Patent Publication (OLS) No. 3,234,533.

Colored couplers for correction of unnecessary absorptions of the developed dye preferably include those described in Research Disclosure No. 17643, VII-G, Research Disclosure No. 307105, VII-G, U.S. Pat. Nos. 4,163,670, 4,004,929 and 4,138,258, JP-B-57-39413 and British Patent 1,146,368. Furthermore, couplers for correction of unnecessary absorption of the developed dye by a fluorescent dye released upon coupling as described in U.S. Pat. No. 4,774,181 and couplers containing as a release group a dye precursor group capable of reacting with a developing agent to form a dye as described in U.S. Pat. No. 4,777,120 can be preferably used.

Compounds capable of releasing a photographically useful residue upon coupling can also be used in the present invention. Preferred examples of DIR couplers which release a development inhibitor are described in the patents cited in Research Disclosure Nos. 17643, VII-F and 307105, VII-F, JP-A-57-151944, JP-A-57-154234, JP-A-60-184248, JP-A-63-37346, JP-A-63-37350 and U.S. Pat. Nos. 4,248,962 and 4,782,012.

Bleach accelerator-releasing couplers as disclosed in Research Disclosure Nos. 11449 and 24241 and JP-A-61-201247 are effective for the reduction of time required for processing step having bleaching capability. In particular, when incorporated in a light-sensitive material comprising the above mentioned tabular silver halide grains, these couplers remarkably exhibit its effect. Couplers capable of imagewise releasing a nucleating agent or a developing accelerator at the time of development preferably include those described in British Patents 2,097,140 and 2,131,188, JP-A-59-157638 and JP-A-59-170840. Further, compounds which undergo redox reaction with the oxidation product of a developing agent to release a fogging agent, a development accelerator, a silver halide solvent or the like as disclosed in JP-A-60-107029, JP-A-60-252340, JP-A-1-44940 and JP-A-1-45687 are preferred.

In addition to the foregoing couplers, the photographic material of the present invention can further comprise competing couplers as described in U.S. Pat. No. 4,130,427, polyequivalent couplers as described in U.S. Pat. Nos. 4,283,472, 4,338,393 and 4,310,618, DIR redox compound-releasing couplers, DIR coupler-releasing couplers, DIR coupler-releasing redox compounds or DIR redox-releasing redox compounds as described in JP-A-60-185950 and JP-A-62-24252, couplers capable of releasing a dye which returns to its original color after release as described in European Patents 173,302A and 313,308A, couplers capable of releasing a ligand as described in U.S. Pat. No. 4,555,477, couplers capable of releasing a leuco dye as described in JP-A-63-75747, and couplers capable of releasing a fluorescent dye as described in U.S. Pat. No. 4,774,181.

The incorporation of the couplers for use in the present invention in the light-sensitive material can be accomplished by any suitable known dispersion method.

Examples of high boiling solvents to be used in the oil-in-water dispersion process are described in U.S. Pat. No. 2,322,027. Specific examples of high boiling organic solvents having a boiling point of 175° C. or higher at normal pressure which can be used in the oil-in-water dispersion process include phthalic esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxy ethyl phosphate, trichloropropyl phosphate, di-2-ethylhexyl phenyl phosphonate), benzoic esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis (2-ethylhexyl) sebacate, dioctyl azerate, glycerol tributylate, isostearyl lactate, trioctyl citrate), aniline derivatives (e.g., N,N-dibutyl-2-butoxy-5-tert-octylaniline), and hydrocarbons (e.g., paraffin, dodecylbenzene, diisopropylnaphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of latex dispersion method and specific examples of latexes to be used in dipping are described in U.S. Pat. No. 4,199,363, West German Patent Publication (OLS) Nos. 2,541,274 and 2,541,230.

The color light-sensitive material of the present invention preferably comprises various antiseptics or anti-fungal agents such as phenetyl alcohol and 1,2-benziso-thiazoline-3-one, n-butyl-p-hydroxybenzoate, phenol, 4-chloro-3,5-dimethylphenol, 2-phenoxyethanol and 2-(4-thiazolyl)benzimidazole as described in JP-A-63-257747, JP-A-62-272248 and JP-A-1-80941.

Suitable supports which can be used in the present invention are described in the above cited Research Disclosure No. 17643 (page 28), No. 18716 (right column on page 647 to left column on page 648), and No. 307105 (page 897).

In the light-sensitive material of the present invention, the total thickness of all hydrophilic colloidal layers on the emulsion side is preferably in the range of 28 μm or less, more preferably 23 μm or less, further preferably 18 μm or less, particularly 16 μm or less. The film swelling $T_{1/2}$ is preferably in the range of 30 seconds or less, more preferably 20 seconds or less. In the present invention, the film thickness is determined after being stored at a temperature of 25° C. and a relative humidity of 55% for 2 days. The film swelling $T_{1/2}$ can be determined by a method known in the art, e.g., by means of a swellometer of the type as described in A. Green et al., "Photographic Science and Engineering", vol. 19, No. 2, pp. 124–129. $T_{1/2}$ is defined as the time taken until half the saturated film thickness is reached wherein the saturated film thickness is 90% of the maximum swollen film thickness reached when the light-sensitive material is processed with a color developer at a temperature of 30° C. over 195 seconds.

The film swelling $T_{1/2}$ can be adjusted by adding a film hardener to gelatin as binder or altering the ageing condition after coating. The percentage swelling of the light-sensitive material is preferably in the range of 150 to 400%. The percentage swelling can be calculated from the maximum swollen film thickness determined as described above in accordance with the equation: (maximum swollen film thickness—film thickness)/film thickness.

The light-sensitive material of the present invention preferably comprises a hydrophilic colloidal layer (hereinafter referred to as "backing layer") having a total dried thickness of 2 μm to 20 μm on the side other than the emulsion layer side. The back layer preferably contains the above mentioned light absorbent, filter dye, ultraviolet absorbent, antistatic agent, hardener, binder, plasticizer, lubricant, coating aid, surface active agent, etc. The backing layer preferably exhibits a percentage swelling of 150 to 500%.

The color developer to be used in the development of the light-sensitive material of the present invention is preferably an alkaline aqueous solution containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxy-ethylaniline, 3-methyl-4-amino-N-ethyl-N-β-methanesulfonamidoethylaniline, 3-methyl-4-amino-N-ethyl-N-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl) aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and sulfates, hydrochlorides and p-toluenesulfonates thereof. Particularly preferred among these compounds are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and hydrochlorides, p-toluenesulfonates and sulfates thereof. These compounds can be used in combination of two or more thereof depending on the purpose of application.

The color developer normally contains a pH buffer such as carbonate, borate and phosphate of an alkali metal or a development inhibitor or fog inhibitor such as chlorides, bromides, iodides, benzimidazoles, benzothiazoles and mercapto compounds. If desired, the color developer may further contain various preservatives such as hydroxylamine, diethylhydroxylamine, sulfites, hydrazines (e.g., N,N-bis-carboxymethylhydrazine), phenylsemicarbazides, tri-ethanolamine and catecholsulfonic acids, organic solvents such as ethylene glycol and diethylene glycol, development accelerators such as benzyl alcohol, polyethylene glycol, quaternary ammonium salts, and amines, color-forming couplers, competing couplers, auxiliary developing agents such as 1-phenyl-3-pyrazolidone, viscosity-imparting agents, various chelating agents exemplified by aminopolycarboxylic acids, aminopolyphosphonic acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof).

The processing solutions for the color reversal photographic light-sensitive material according to the present invention other than color developer and the processing procedures for the color reversal photographic light-sensitive material will be described hereinafter.

Examples of procedures from black-and-white development to color development among the processing procedures for the color reversal photographic light-sensitive material according to the present invention include:

1) Black-and-white development—washing—reversal—color development

2) Black-and-white development—washing—light reversal—color development

3) Black-and-white development—washing—color development

In the foregoing procedures 1) to 3), the washing step may be replaced by rinsing step described in U.S. Pat. No. 4,804,616 to attain the simplification of processing and the reduction of waste liquid.

The procedures following the color development step will be described hereinafter.

4) Color development—adjustment—bleach—fixing—washing—stabilization

5) Color development—washing—bleach—fixing—washing—stabilization

6) Color development—adjustment—bleach— washing—fixing—washing—stabilization

7) Color development—washing—bleach—washing—fixing—washing—stabilization

8) Color development—bleach—fixing—washing—stabilization

9) Color development—bleach—blix—washing—stabilization

10) Color development—bleach—blix—fixing—washing—stabilization

11) Color development—bleach—washing—fixing—washing—stabilization

12) Color development—adjustment—blix—washing—stabilization

13) Color development—washing—blix—washing—stabilization

14) Color development—blix—washing—stabilization

15) Color development—fixing—blix—washing—stabilization

In the foregoing procedures 4) to 15), the washing step shortly before stabilization may be omitted. Alternatively, the stabilization step as final step may be omitted. Any one of the foregoing procedures 1) to 3) is connected to any one of the foregoing procedures 4) to 15) to establish the color reversal process.

The processing solutions for the color reversal process according to the present invention will be described hereinafter.

The black-and-white developer to be used in the present invention may comprise known developing agents. As such developing agents there may be used dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, and heterocyclic compounds obtained by condensation of 1,2,3,4-tetrahydroquinoline ring with indolene ring as disclosed in U.S. Pat. No. 4,067,872, singly or in combination.

The black-and-white developer to be used in the present invention may further comprise a preservative (e.g., sulfite, bisulfite), a buffer (e.g.-, carbonate, boric acid, borate, alkanolamine), an alkaline agent (e.g., hydroxide, carbonate), a dissolution aid (e.g., polyethylene glycol, ester thereof), a pH adjustor (e.g., organic acid such as acetic acid), a sensitizer (e.g., quaternary ammonium salt), a development accelerator, a surface active agent, an anti-foaming agent, a hardener, a viscosity-imparting agent, etc. as necessary.

The black-and-white developer to be used in the present invention needs to comprise a compound serving as a silver halide solvent. However, the sulfite added as a preservative normally serves as a silver halide solvent. Specific examples of such a sulfite and other employable silver halide solvents include KSCN, NaSCN, $K_2SO_3$, $Na_2SO_3$, $K_2S_2O_5$, $Na_2S_2O_5$, $K_2S_2O_3$, and $Na_2S_2O_3$.

The pH value of the developer thus prepared is selected such that the desired density and contrast can be provided and is in the range of about 8.5 to about 11.5.

In order to effect sensitization with such a black-and-white developer, the processing may be normally extended up to about three times the standard processing. By elevating the processing temperature, the processing time to be extended for sensitization can be reduced.

The color developer or black-and-white developer usually has a pH of from 9 to 12. The replenishment rate of the developer is usually 3 l or less per $m^2$ of the light-sensitive material, though depending on the type of the color photographic material to be processed. The replenishment rate may be reduced to 500 ml/$m^2$ or less by decreasing the bromide ion concentration in the replenisher. If the replenishment rate is reduced, the area of the processing tank in contact with air is preferably reduced to inhibit the evaporation and air oxidation of the processing solution.

The area of the photographic processing solution in contact with air in the processing tank can be represented by an opening rate as defined by the following equation:

$$\text{Opening rate} = [\text{area of processing solution in contact with air } (cm^2)]/[\text{volume of processing solution } (cm^3)]$$

The opening rate as defined above is preferably in the range of 0.1 or less, more preferably 0.001 to 0.05. Examples of methods for reducing the opening rate include a method which comprises putting a cover such as floating lid on the surface of the processing solution in the processing tank, a method as disclosed in JP-A-1-82033 utilizing a mobile lid, and a slit development method as disclosed in JP-A-63-216050. The reduction of the opening rate is preferably effected in both color development and black-and-white development steps as well as all the subsequent steps such as bleach, blix, fixing, washing and stabilization. The replenishment rate can also be reduced by a means for suppressing accumulation of the bromide ion in the developing solution.

The reversal bath used following black-and-white development may comprise known fogging agents. Examples of such fogging agents include stannous ion complex salts such as stannous ion-organic phosphoric acid complex salt (as disclosed in U.S. Pat. No. 3,617,282), stannous ion-organic phosphonocarboxylic acid complex salt (as disclosed in JP-B-56-32616) and stannous ion-aminopolycarboxylic acid complex salt (as disclosed in U.S. Pat. No. 1,209,050), and boron compounds such as hydrogenated boron compound (as disclosed in U.S. Pat. No. 2,984,567) and heterocyclic amineborane compound (as disclosed in British Patent 1,011,000). The pH value of the fogging bath (reversal bath) ranges widely from acidic side to alkaline side, i.e., 2 to 12, preferably 2.5 to 10, particularly 3 to 9. Light reversal by re-exposure may be effected instead of the foregoing reversal process. Alternatively, the foregoing fogging agents may be added to the color developer to omit the reversal process.

The silver halide color photographic material of the present invention which has been subjected to color development is then subjected to bleaching or blix. These processing steps may be immediately effected after color development without passing through any other processing steps or may be effected via processing steps such as stop, adjustment and washing after color development to inhibit undesirable post development and aerial fog and reduce the amount of color developer to be brought over to desilvering step or wash color developing agents with which the photographic light-sensitive material is impregnated and sensitizing dyes and dyestuffs which the photographic light-sensitive material contains and hence make it harmless.

The photographic emulsion layer which has been color-developed is normally subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of potyvalent metals, e.g., iron (III), peroxides, quinones, and nitro compounds. Typical examples of these bleaching agents are organic complex salts of iron (III) with, e.g., aminopolycarboxylic acids such as ethylenediaminetetraacetic acid, diethylenetriaminepentaacetic acid, cyclohexanediaminetetraacetic acid, methyliminodiacetic acrid, 1,3-diaminopropanetetraacetic acid and glycol ether diaminetetraacetic acid, or citric acid, tartaric acid, malic acid, etc. Of these, aminopolycarboxylic acid-iron (III) complex salts such as ethylenediaminetetraacetato iron (III) complex salts and 1,3-diaminopropanetetraacetato iron (III) complex salts are preferred in view of speeding up of processing and conservation of the environment. In particular, aminopolycarboxylic acid-iron (III) complex salts are useful in both of a bleaching solution and a blix solution. The pH value of a bleaching solution or blix solution comprising such an antinopolycarboxylic acid-iron (III) complex salts is normally in the range of 4.0 to 8. For speeding up of processing, the processing can be effected at an even lower pH value.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and Research Disclosure No. 17129 (July 1978), thiazolidine derivatives as described in JP-A-50-140129, thiourea derivatives as described in JP-B-45-8506, JP-A-52-20832, JP-A-53-32735 and U.S. Pat. No. 3,706,561, iodides as described in West German Patent 1,127,715 and JP-A-58-16235, polyoxyethylene compounds as described in West German Patents 966,410 and 2,748,430, polyamine compounds as described in JP- B-45-8836, compounds as described in JP-A-49-40943, JP-A-49-59644, JP-A-53-94927, JP-A-54-35727, JP-A-55-26506 and JP-A-58-163940, and bromine ions. Preferred among these compounds are compounds containing a mercapto group or disulfide group because of their great acceleratory effects. In particular, the compounds disclosed in U.S. Pat. No. 3,893,858, West German Patent 1,290,812 and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix of color light-sensitive materials for picture taking.

The bleaching solution or blix solution preferably contains an organic acid besides the above mentioned compounds for the purpose of inhibiting bleach stain. A particularly preferred organic acid is a compound with an acid dissociation constant (pKa) of 2 to 5. In particular, acetic acid, propionic acid, hydroxyacetic acid, etc. are preferred.

Examples of fixing agents to be contained in the fixing solution or blix solution include thiosulfates, thiocyanates, thioethers, thioureas, and a large amount of iodides. The thiosulfites are normally used. In particular, ammonium thiosulfate can be most widely used. Further, thiosulfates are preferably used in combination with thiocyanates, thioether compounds, thioureas, etc. As preservatives of the fixing or blix bath there can be preferably used sulfites, bisulfites, carbonyl bisulfite adducts or sulfinic acid compounds as described in European Patent 294769A. The fixing solution or blix solution preferably contains aminopolycarboxylic acids or organic phosphonic acids for the purpose of stabilizing the solution.

The total time required for desilvering step is preferably as short as possible so long as no maldesilvering occurs. The desilvering time is preferably in the range of 1 to 3 minutes, more preferably 1 to 2 minutes. The processing temperature is in the range of 25° C. to 50° C., preferably 35° C. to 45° C. In the preferred temperature range, the desilvering rate can be improved and stain after processing can be effectively inhibited.

In the desilvering step, the agitation is preferably intensified as much as possible. Specific examples of such an agitation intensifying method include a method as described in JP-A-62-183460 which comprises jetting the processing solution to the surface of the emulsion layer in the light-sensitive material, a method as described in JP-A-62-183461 which comprises improving the agitating effect by a rotary means, a method which comprises improving the agitating effect by moving the light-sensitive material with the emulsion surface in contact with a wiper blade provided in the bath so that a turbulence occurs on the emulsion surface, and a method which comprises increasing the total circulated amount of processing solution. Such an agitation improving method can be effectively applied to the bleaching bath, blix bath or fixing bath. The improvement in agitation effect can be considered to expedite the supply of a bleaching agent, fixing agent or the like into emulsion film, resulting in an improvement in desilvering rate. The above mentioned agitation improving means can work more effectively when a bleach accelerator is used, remarkably increasing the bleach acceleration effect and eliminating the inhibition of fixing by the bleach accelerator.

The automatic developing machine to be used in the processing of the light-sensitive material of the present invention is preferably equipped with a light-sensitive material conveying means as disclosed in JP-A-60-191257, JP-A-60-191258 and JP-A-60-191259. Such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

It is usual that the thus desilvered silver halide color photographic material of the present invention are subjected to washing and/or stabilization. The quantity of water to be used in the washing can be selected from a broad range depending on the characteristics of the light-sensitive material (for example, the kind of materials such as couplers, etc.), the end use of the light-sensitive material, the temperature of washing water, the number of washing tanks (number of stages), the replenishment system (e.g., counter-current system or concurrent system), and other various factors. Of these factors, the relationship between the number of washing tanks and the quantity of water in a multi-stage counter-current system can be obtained according to the method described in "Journal of the Society of Motion Picture and Television Engineers", vol. 64, pp. 248–253 (May 1955). According to the multi-stage counter-current system described in the above reference, although the requisite amount of water can be greatly reduced, bacteria would grow due to an increase of the retention time of water in the tank, and floating masses of bacteria stick to the light-sensitive material. In the processing for the color light-sensitive material of the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, "Bokinbobaizai no kagaku", published by Sankyo Shuppan, (1986), Eisei Gijutsu Gakkai (ed.), "Biseibutsu no mekkin, sakkin, bobigijutsu", Kogyo-gijutsukai, (1982), and Nippon Bokin Bobi Gakkai (ed.), "Bokin bobizai jiten" (1986).

The washing water has a pH value of from 4 to 9, preferably from 5 to 8 in the processing for the light-sensitive material of the present invention. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 45° C. in temperature and from 30 seconds to 5 minutes in time. The light-sensitive material of the present invention may be directly processed with a stabilizer in place of the washing step. For the stabilization, any of the known techniques as described in JP-A-57-8543, JP-A-58-14834 and JP-A-60-220345 can be used.

The aforesaid washing step may be followed by stabilization in some cases. For example, a stabilizing bath containing a dye stabilizer and a surface active agent as is used as a final bath for color light-sensitive materials for picture taking can be used. Examples of such a dye stabilizer include aldehydes such as formalin and glutaraldehyde, N-methylol compounds, hexamethylenetetramine and aldehyde-bisulfite adducts. This stabilizing bath may also contain various chelating agents or antifungal agents.

The overflow accompanying replenishment of the washing bath and/or stabilizing bath can be reused in other steps such as desilvering.

In a processing using an automatic developing machine, if the above mentioned various processing solutions are subject to concentration due to evaporation, the concentration is preferably corrected for by the addition of water.

The silver halide color light-sensitive material of the present invention may contain a color developing agent for the purpose of simplifying and expediting processing. Such a color developing agent is preferably used in the form of various precursors, when it is contained in the light-sensitive material. Examples of such precursors include indoaniline compounds as described in U.S. Pat. No. 3,342,597, Schiff's base type compounds as described in U.S. Pat. No. 3,342,599, and Research Disclosure Nos. 14,850 and 15,159, and aldol compounds as described in Research Disclosure No. 13,924, metal complexes as described in U.S. Pat. No. 3,719,492, and urethane compounds as described in JP-A-53-135628.

The silver halide color light-sensitive material of the present invention may optionally comprise various 1-phenyl-3-pyrazolidones for the purpose of accelerating color development. Typical examples of such compounds are described in JP-A-56-64339, JP-A-57-144547 and JP-A-58-115438.

In the present invention, the various processing solutions are used at a temperature of 10° C. to 50° C. The standard temperature range is normally from 33° C. to 38° C. However, a higher temperature range can be used to accelerate processing, reducing the processing time. On the contrary, a lower temperature range can be used to improve the picture quality or the stability of the processing solutions.

The present invention will be further described in the following examples, but the present invention should not be construed as being limited thereto.

EXAMPLE 1

Emulsions A to O as set forth in Table 1 were prepared in accordance with the method as described in JP-A-2-838, and then each subjected to optimum gold and sulfur sensitization. To these emulsions were then added sensitizing dyes as set forth in Tables 2 and 3 below. With these silver bromoiodide emulsions A to O, various layers having the following compositions were coated on an undercoated 127-μm thick cellulose triacetate film support to prepare a multi-layer color photographic light-sensitive material as Specimen 101. The numeral indicates the amount of each component added per $m^2$. The effect of the compounds thus added are not limited to the purpose described.

| | |
|---|---|
| 1st layer: antihalation layer | |
| Black colloidal silver | 0.3 g |
| Gelatin | 2.2 g |
| Ultraviolet absorbent U-1 | 0.1 g |
| Ultraviolet absorbent U-3 | 0.05 g |
| Ultraviolet absorbent U-4 | 0.1 g |
| High boiling organic solvent Oil-1 | 0.1 g |
| Solid dispersion of microcrystal of Dye E-1 | 0.1 g |
| 2nd layer: interlayer | |
| Gelatin | 0.40 g |
| Compound Cpd-C | 5 mg |
| Compound Cpd-J | 3 mg |
| Compound Cpd-K | 3 mg |
| High boiling organic solvent Oil-3 | 0.1 g |
| Dye D-4 | 9 mg |
| 3rd layer: interlayer | |
| An emulsion of a finely divided, surface- and internal-fogged, silver bromoiodide grain (average grain diameter: 0.06 μm; fluctuation coefficient: 18%; AgI content: 1 mol %) | 0.05 g as calculated in terms of silver |
| Gelatin | 0.4 g |
| 4th layer: low sensitivity red-sensitive emulsion layer | |
| Emulsion A | 0.5 g as calculated in terms of silver |
| Emulsion B | 0.3 g as calculated in terms of silver |
| Gelatin | 0.8 g |
| Coupler C-1 | 0.1 g |
| Coupler C-2 | 0.25 g |
| Coupler C-3 | 0.1 g |
| Compound Cpd-C | 5 mg |
| Compound Cpd-J | 5 mg |
| High boiling organic solvent Oil-2 | 0.1 g |
| Additive P-1 | 0.1 g |
| 5th layer: middle sensitivity red-sensitive emulsion layer | |
| Emulsion B | 0.2 g as calculated in terms of silver |
| Emulsion C | 0.3 g as calculated in terms of silver |
| Gelatin | 0.8 g |
| Coupler C-1 | 0.05 g |
| Coupler C-2 | 0.15 g |
| Coupler C-3 | 0.2 g |
| High boiling organic solvent Oil-2 | 0.1 g |
| Additive P-1 | 0.1 g |
| 6th layer: high sensitivity red-sensitive emulsion layer | |
| Emulsion D | 0.4 g as calculated in terms of silver |
| Gelatin | 1.1 g |

-continued

| | |
|---|---|
| Coupler C-1 | 0.05 g |
| Coupler C-2 | 0.15 g |
| Coupler C-3 | 0.1 g |
| Coupler C-9 | 0.15 g |
| Additive P-1 | 0.1 g |
| 7th layer: interlayer | |
| Gelatin | 0.6 g |
| Additive M-1 | 0.3 g |
| Color stain preventing agent Cpd-I | 0.03 g |
| Dye D-5 | 0.02 g |
| Compound Cpd-J | 5 mg |
| High boiling organic solvent Oil-1 | 0.02 g |
| 8th layer: interlayer | |
| An emulsion of a finely divided, surface- and internal-logged, silver bromoiodide grain (average grain diameter: 0.06 μm; fluctuation coefficient: 16%; AgI content: 0.3 mol %) | 0.02 g as calculated in terms of silver |
| Gelatin | 1.0 g |
| Additive P-1 | 0.2 g |
| Color stain preventing agent Cpd-A | 0.1 g |
| Compound Cpd-C | 0.1 g |
| 9th layer: low sensitivity green-sensitive emulsion layer | |
| Emulsion E | 0.3 g as calculated in terms of silver |
| Emulsion F | 0.3 g as calculated in terms of silver |
| Emulsion G | 0.3 g as calculated in terms of silver |
| Gelatin | 0.5 g |
| Coupler C-4 | 0.05 g |
| Coupler C-11 | 0.1 g |
| Coupler C-7 | 0.05 g |
| Coupler C-8 | 0.20 g |
| Compound Cpd-B | 0.03 g |
| Compound Cpd-D | 0.02 g |
| Compound Cpd-E | 0.02 g |
| Compound Cpd-F | 0.04 g |
| Compound Cpd-J | 10 mg |
| Compound Cpd-L | 0.02 g |
| High boiling organic solvent Oil-1 | 0.1 g |
| High boiling organic solvent Oil-2 | 0.1 g |
| 10th layer: middle sensitivity green-sensitive emulsion layer | |
| Emulsion G | 0.3 g as calculated in terms of silver |
| Emulsion H | 0.2 g as calculated in terms of silver |
| Gelatin | 0.6 g |
| Coupler C-4 | 0.1 g |
| Coupler C-11 | 0.15 g |
| Coupler C-7 | 0.05 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-L | 0.05 g |
| High boiling organic solvent Oil-2 | 0.01 g |
| 11th layer: high sensitivity green-sensitive emulsion layer | |
| Emulsion I | 0.3 g as calculated in terms of silver |
| Emulsion J | 0.2 g as |

-continued

| | |
|---|---|
| | calculated in terms of silver |
| Gelatin | 1.0 g |
| Coupler C-4 | 0.15 g |
| Coupler C-11 | 0.15 g |
| Coupler C-7 | 0.05 g |
| Coupler C-8 | 0.1 g |
| Compound Cpd-B | 0.03 g |
| Compound Cpd-E | 0.02 g |
| Compound Cpd-F | 0.04 g |
| Compound Cpd-K | 5 mg |
| Compound Cpd-L | 0.02 g |
| High boiling organic solvent Oil-1 | 0.02 g |
| High boiling organic solvent Oil-2 | 0.02 g |
| 12th layer: interlayer | |
| Gelatin | 0.6 g |
| Compound Cpd-L | 0.05 g |
| High boiling organic solvent Oil-1 | 0.05 g |
| 13th layer: yellow filter layer | |
| Yellow colloidal silver | 0.07 g as calculated in terms of silver |
| Gelatin | 1.1 g |
| Color stain preventing agent Cpd-A | 0.01 g |
| Compound Cpd-L | 0.01 g |
| High boiling organic solvent Oil-1 | 0.01 g |
| Solid dispersion of microcrystal of Dye E-2 | 0.05 g |
| 14th layer: interlayer | |
| Gelatin | 0.6 g |
| 15th layer: low sensitivity blue-sensitive emulsion layer | |
| Emulsion K | 0.4 g as calculated in terms of silver |
| Emulsion L | 0.4 g as calculated in terms of silver |
| Gelatin | 0.8 g |
| Coupler C-5 | 0.3 g |
| Coupler C-6 | 0.1 g |
| Coupler C-10 | 0.1 g |
| 16th layer: middle sensitivity blue-sensitive emulsion layer | |
| Emulsion M | 0.2 g as calculated in terms of silver |
| Emulsion N | 0.3 g as calculated in terms of silver |
| Gelatin | 0.9 g |
| Coupler C-5 | 0.4 g |
| Coupler C-6 | 0.05 g |
| Coupler C-10 | 0.15 g |
| 17th layer: high sensitivity blue-sensitive emulsion layer | |
| Emulsion 0 | 0.4 g as calculated in terms of silver |
| Gelatin | 1.2 g |
| Coupler C-5 | 0.1 g |
| Coupler C-6 | 0.1 g |
| Coupler C-10 | 0.6 g |
| High boiling organic solvent Oil-2 | 0.1 g |
| 18th layer: 1st protective layer | |
| Gelatin | 0.7 g |
| Ultraviolet absorbent U-1 | 0.2 g |
| Ultraviolet absorbent U-2 | 0.05 g |
| Ultraviolet absorbent U-5 | 0.3 g |

-continued

| | |
|---|---|
| Formalin scavenger Cpd-H | 0.4 g |
| Dye D-1 | 0.15 g |
| Dye D-2 | 0.05 g |
| Dye D-3 | 0.1 g |
| 19th layer: 2nd protective layer | |
| Colloidal silver | 0.1 mg as calculated in terms of silver |
| An emulsion of a finely divided silver bromoiodide grain (average grain diameter: 0.06 μm; AgI content: 1 mol %) | 0.1 g as calculated in terms of silver |
| Gelatin | 0.4 g |
| 20th layer: 3rd protective layer | |
| Gelatin | 0.4 g |
| Polymethyl methacrylate (average grain diameter: 1.5 μm) | 0.1 g |
| 4:6 Copolymer of methyl methacrylate and acrylic acid (average grain diameter: 1.5 μm) | 0.1 g |
| Silicone oil | 0.03 g |
| Surface active agent W-1 | 3.0 mg |
| Surface active agent W-2 | 0.03 g |

In addition to the above mentioned compositions, additives F-1 to F-8 were incorporated in all these emulsion layers. Besides the above mentioned compositions, a gelatin hardener H-1 and coating and emulsifying surface active agents W-3, W-4, W-5 and W-6 were incorporated in each of the various layers.

Further, phenol, 1,2-benzisothiazoline-3-one, 2-phenoxyethanol, phenethyl alcohol and butyl p-benzoate were incorporated in these layers as antiseptics or mildewproofing agents.

Silver bromoiodide emulsions used in Specimen 101 were as follows:

TABLE 1

| Emulsion | Feature of grain | Average grain diameter in terms of sphere (μm) | Fluctuation coefficient (%) | AgI content (%) |
|---|---|---|---|---|
| A | Monodisperse cubic grain | 0.20 | 10 | 3.7 |
| B | Monodisperse cubic grain | 0.35 | 10 | 3.3 |
| C | Monodisperse cubic grain | 0.50 | 16 | 5.0 |
| D | Polydisperse tabular grain (average aspect ratio: 2.5) | 1.00 | 25 | 2.0 |
| E | Monodisperse cubic grain | 0.15 | 17 | 4.0 |
| F | Monodisperse cubic grain | 0.25 | 16 | 4.0 |
| G | Monodisperse cubic grain | 0.35 | 11 | 3.5 |
| H | Monodisperse cubic grain | 0.50 | 9 | 3.5 |
| I | Polydisperse tabular grain (average aspect ratio: 3.0) | 0.80 | 26 | 2.5 |
| J | Polydisperse tabular grain (average aspect ratio: 9.0) | 1.30 | 28 | 1.5 |
| K | Monodisperse | 0.30 | 16 | 4.0 |

TABLE 1-continued

| Emulsion | Feature of grain | Average grain diameter in terms of sphere (μm) | Fluctuation coefficient (%) | AgI content (%) |
|---|---|---|---|---|
| | cubic grain | | | |
| L | Monodisperse spherical grain | 0.45 | 17 | 4.0 |
| M | Polydisperse tabular grain (average aspect ratio: 4.0) | 0.60 | 26 | 3.5 |
| N | Polydisperse tabular grain (average aspect ratio: 10.0) | 1.00 | 28 | 2.5 |
| O | Polydisperse internally high iodine content type twin grain | 1.90 | 33 | 2.0 |

TABLE 2

(spectral sensitization of Emulsions A–J)

| Emulsion | Added sensitizing dye | Amount added per mole of silver halide (g) |
|---|---|---|
| A | S-1 | 0.35 |
| B | S-1 | 0.2 |
| C | S-1 | 0.15 |
| D | S-1 | 0.1 |
| E | S-2 | 0.5 |

TABLE 2-continued (spectral sensitization of Emulsions A–J)

| Emulsion | Added sensitizing dye | Amount added per mole of silver halide (g) |
|---|---|---|
| | S-4 | 0.1 |
| F | S-2 | 0.3 |
| | S-4 | 0.06 |
| G | S-2 | 0.25 |
| | S-4 | 0.04 |
| H | S-3 | 0.2 |
| | S-4 | 0.06 |
| I | S-3 | 0.15 |
| | S-4 | 0.05 |
| | S-5 | 0.07 |
| J | S-3 | 0.10 |
| | S-4 | 0.03 |
| | S-5 | 0.04 |

TABLE 3

(spectral sensitization of Emulsions K–O)

| Emulsion | Added sensitizing dye | Amount added per mole of silver halide (g) |
|---|---|---|
| K | S-6 | 0.15 |
| L | S-6 | 0.12 |
| M | S-6 | 0.15 |
| N | S-6 | 0.12 |
| O | S-6 | 0.10 |
| | S-7 | 0.03 |

C-1

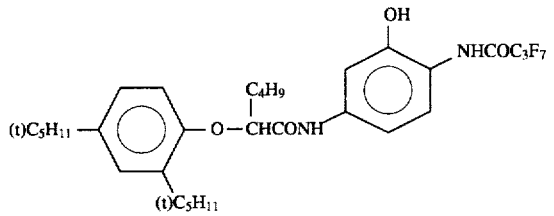

C-2

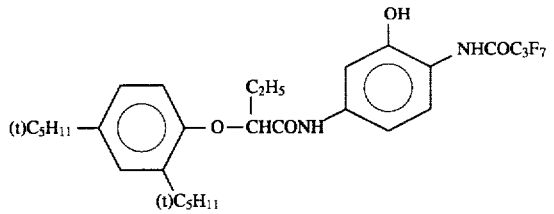

C-3

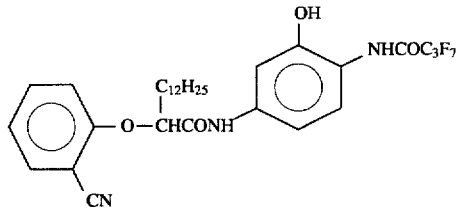

-continued
C-4
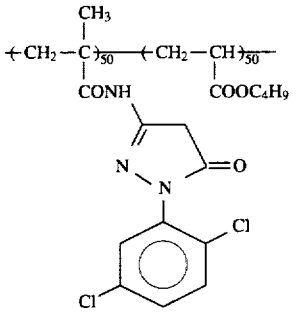
Numeral indicates wt %
Average molecular weight: ca. 25,000
C-5
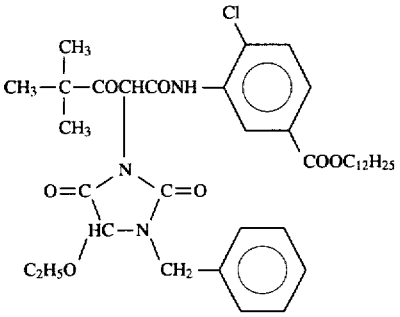
C-6
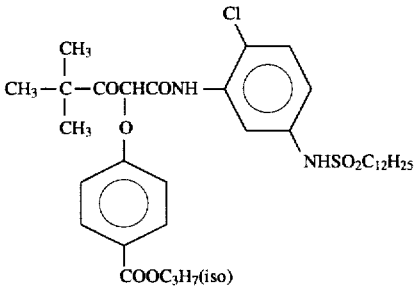
C-7
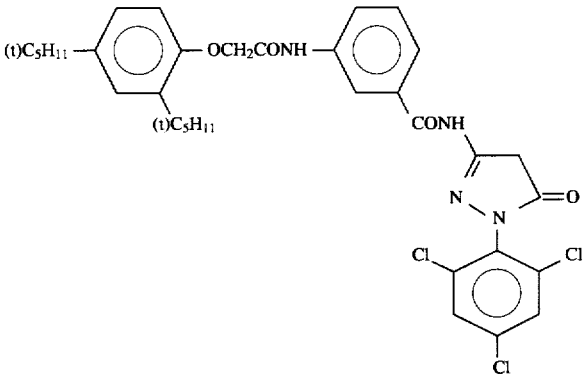
C-8
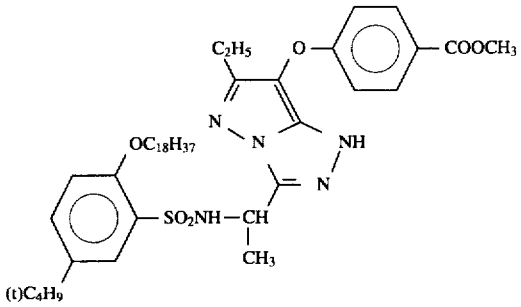

-continued
C-9
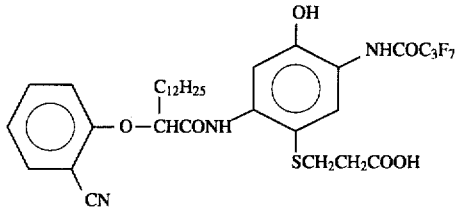
C-10
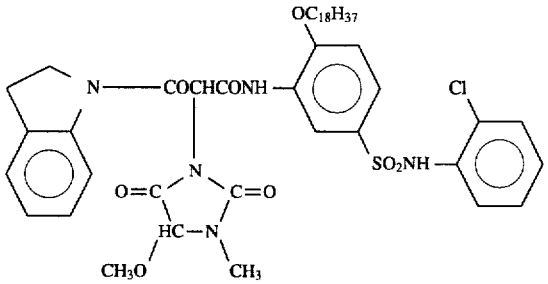
C-11
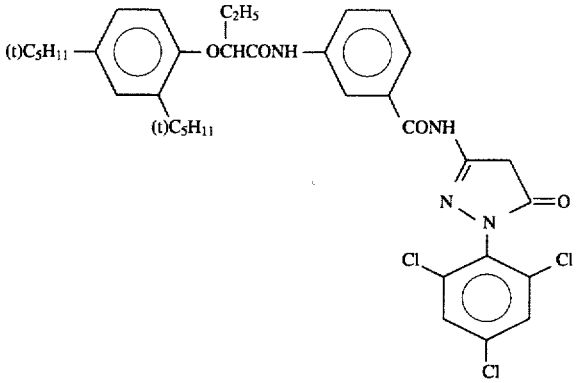
Oil-1: Dibutyl phthalate
Oil-2: Tricresyl phosphate
Oil-3:
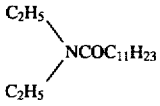
Cpd-A
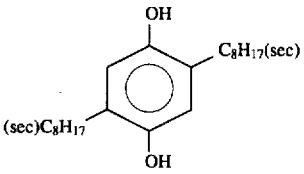
Cpd-B
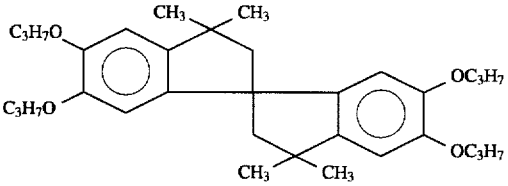
Cpd-C
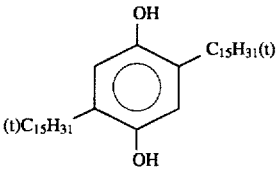

-continued
Cpd-D
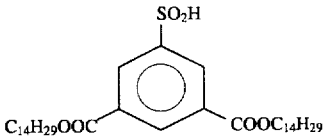
Cpd-E
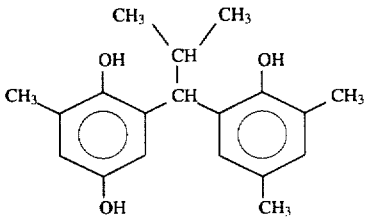
Cpd-F
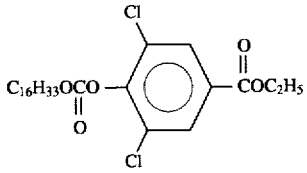
Cpd-H
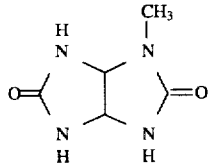
Cpd-I
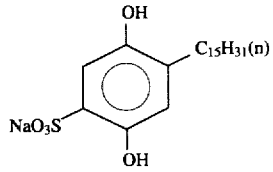
Cpd-J
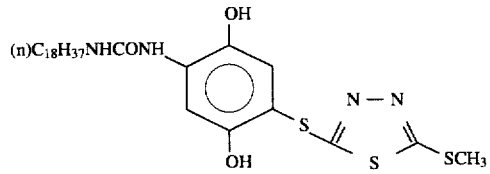
Cpd-K
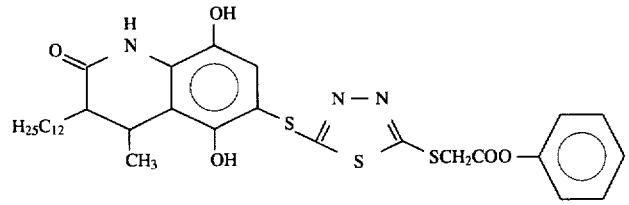
Cpd-L
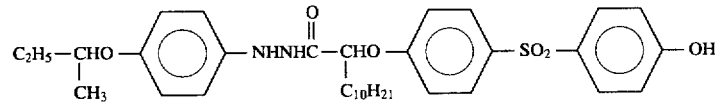
U-1
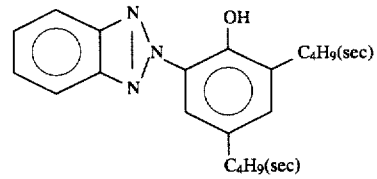

-continued
U-2
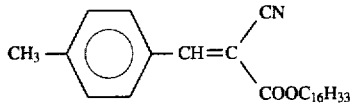
U-3
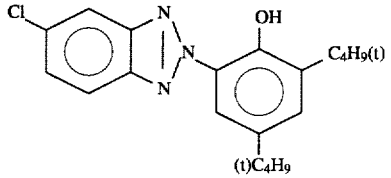
U-4
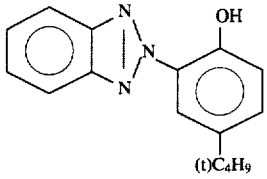
U-5
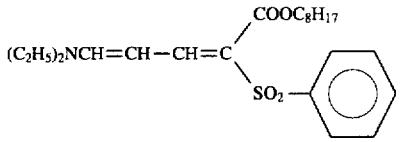
S-1
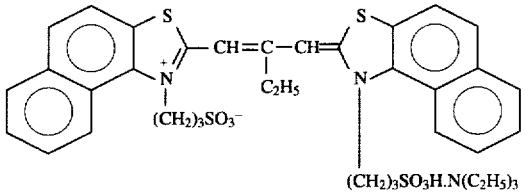
S-2
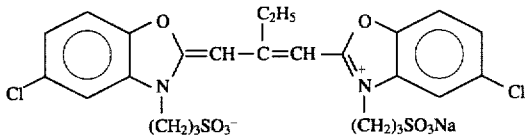
S-3
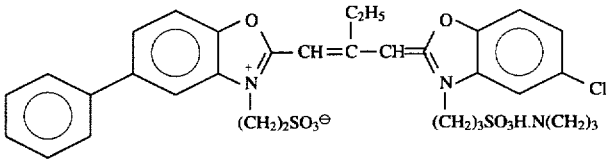
S-4
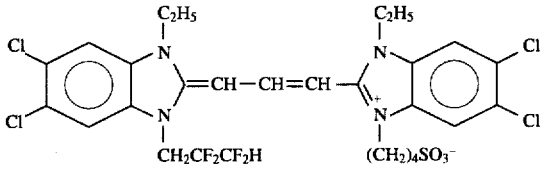
S-5
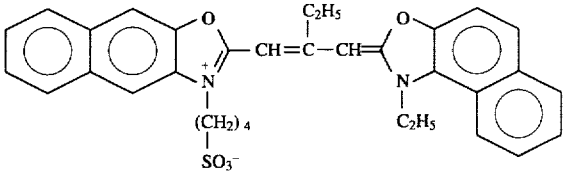

-continued
S-6
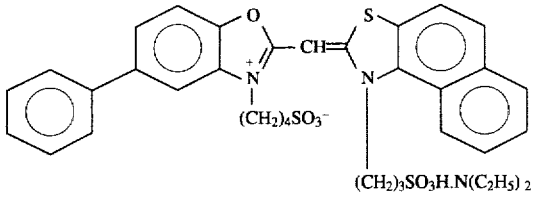
S-7
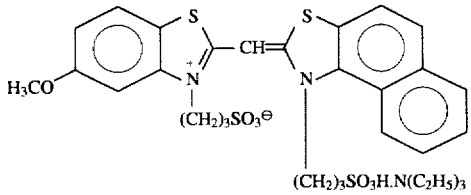
D-1
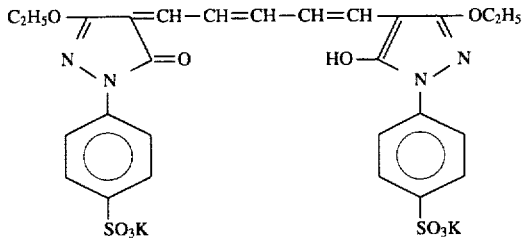
D-2
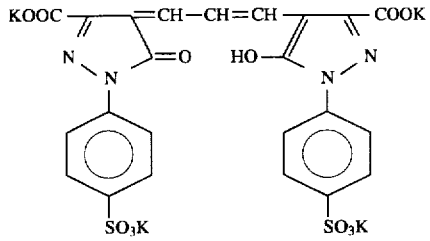
D-3
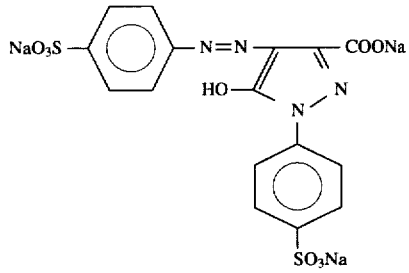
D-4
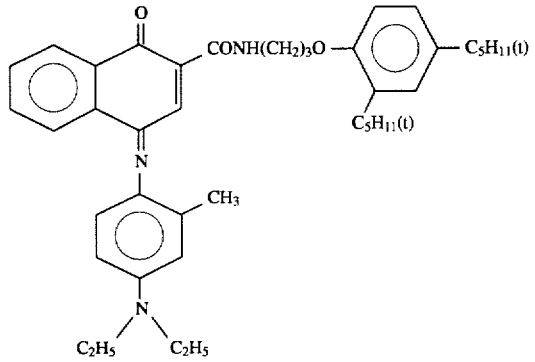

-continued
D-5
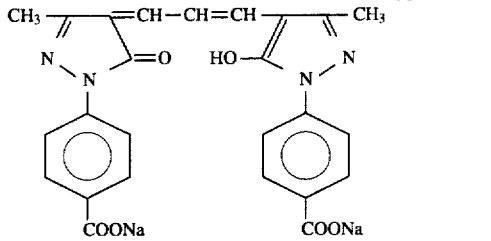
E-1
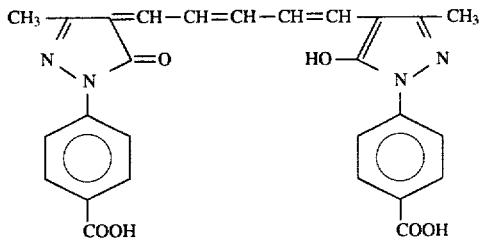
E-2
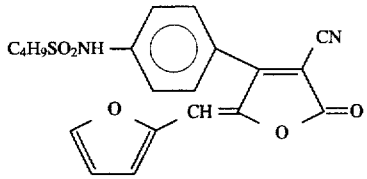
H-1
$CH_2{=}CH{-}SO_2{-}CH_2{-}CONH{-}CH_2$
$\quad\quad\quad -continued

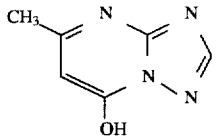

F-1

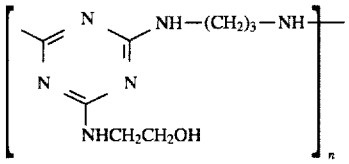

F-2

$-HNO_3$ $4 < n (< 10)$

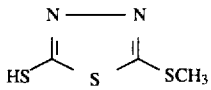

F-3

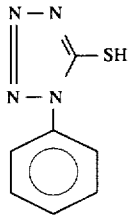

F-4

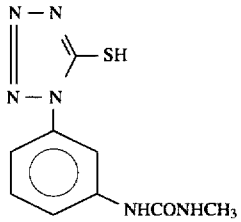

F-5

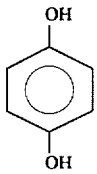

F-6

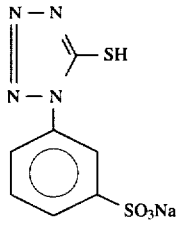

F-7

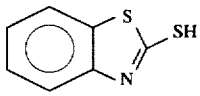

F-8

Preparation of Specimens 102–105

Specimens 102 to 105 were prepared in the same manner as Specimen 101 except that Emulsions A to O used in Specimen 101 were replaced by the emulsions set forth in Tables 4 to 8, respectively.

Preparation of Specimens 106–109

Specimens 106 to 109 were prepared in the same manner as Specimens 101 to 104 except that the coated amounts of emulsions in the various layers in Specimens 101 to 104 as calculated in terms of silver were altered to those set forth in Table 9, respectively.

Preparation of Specimen 110

Specimen 110 was prepared in the same manner as Specimen 105 except that Emulsions D, J and O used in Specimen 105 were replaced by the emulsions set forth in Tables 4 to 8, respectively.

Preparation of Specimen 111

Specimen 111 was prepared in the same manner as Specimen 106 except that Emulsions A to O used in Specimen 106 were replaced by the emulsions set forth in Tables 4 to 8, respectively.

Preparation of Specimen 112

Specimen 112 was prepared in the same manner as Specimen 111 except that Emulsions D, I, J, M and N used in Specimen 111 were replaced by the emulsions set forth in Tables 4 to 8, respectively. Emulsion D consists of two emulsions D and D' having different sizes as set forth in Tables 4 to 8. The coated amounts of the emulsions D and D' as calculated in terms of silver were adjusted such that they total the specified amount of Emulsion D in Specimen 111 as calculated in terms of silver.

Preparation of Specimens 113 and 114

Specimens 113 and 114 were prepared in the same manner as Specimen 105 except that the coated amounts of emulsions in the various layers in Specimen 105 as calculated in terms of silver were altered to those set forth in Table 9, respectively.

The silver bromoiodide emulsions used in Specimens 102 to 112 are as follows.

TABLE 4

| | | Specimen 102 | | | Specimen 103 | | |
|---|---|---|---|---|---|---|---|
| Emulsion | AgI content (%) | Feature of grain | Average grain diameter in terms of sphere (μm) | Fluctuation coefficient (%) | Feature of grain | Average grain diameter in terms of sphere (μm) | Fluctuation coefficient (%) |
| A | 3.7 | Monodisperse, cubic | 0.20 | 10 | Monodisperse, cubic | 0.19 | 10 |
| B | 3.3 | " | 0.35 | 10 | " | 0.31 | 10 |
| C | 5.0 | " | 0.50 | 14 | " | 0.42 | 14 |
| D | 2.0 | " | 0.86 | 15 | Polydisperse, tabular Average aspect ratio: 2.5 | 0.80 | 25 |
| E | 4.0 | " | 0.15 | 17 | Monodisperse, cubic | 0.14 | 17 |
| F | 4.0 | " | 0.25 | 16 | " | 0.24 | 16 |
| G | 3.5 | " | 0.35 | 11 | " | 0.31 | 11 |
| H | 3.5 | " | 0.50 | 9 | " | 0.42 | 9 |
| I | 2.5 | " | 0.75 | 14 | Polydisperse, tabular Average aspect ratio: 3.0 | 0.69 | 24 |
| J | 1.5 | " | 0.86 | 15 | Polydisperse, tabular Average aspect ratio: 9.0 | 1.03 | 28 |
| K | 4.0 | " | 0.30 | 16 | Monodisperse, cubic | 0.29 | 16 |
| L | 4.0 | " | 0.45 | 17 | " | 0.41 | 17 |
| M | 3.5 | Polydisperse, tabular Average aspect ratio: 4.0 | 0.60 | 26 | Polydisperse, tabular Average aspect ratio: 4.0 | 0.52 | 26 |
| N | 2.5 | Polydisperse, tabular Average aspect ratio: 10.0 | 1.00 | 26 | Polydisperse, tabular Average aspect ratio: 10.0 | 0.85 | 26 |
| O | 2.0 | Polydisperse, internally high iodine type, twin | 1.40 | 37 | Polydisperse, internally high iodine type, twin | 1.51 | 37 |

| | Specimen 104 | | |
|---|---|---|---|
| Emulsion | Feature of grain | Average grain diameter in terms of sphere (μm) | Fluctuation coefficient (%) |
| A | Monodisperse, cubic | 0.20 | 10 |
| B | " | 0.33 | 11 |
| C | " | 0.46 | 14 |
| D | Polydisperse, tabular Average aspect ratio: 2.5 | 1.07 | 24 |
| E | Mondisperse, cubic | 0.15 | 17 |
| F | " | 0.24 | 17 |
| G | " | 0.33 | 11 |
| H | " | 0.45 | 11 |
| I | Polydisperse, tabular Average aspect ratio: 3.0 | 0.86 | 22 |
| J | Polydisperse, tabular Average aspect ratio: 9.0 | 1.39 | 27 |
| K | Monodisperse, cubic | 0.29 | 16 |
| L | " | 0.43 | 17 |
| M | Polydisperse, tabular | 0.56 | 27 |

TABLE 4-continued

| | | | |
|---|---|---|---|
| | Average aspect ratio: 4.0 | | |
| N | Polydisperse, tabular<br>Average aspect ratio: 10.0 | 0.92 | 28 |
| O | Polydisperse, internally high iodine type, twin | 2.00 | 36 |

TABLE 5

| | | Specimen 105 | | | Specimen 106 | | |
|---|---|---|---|---|---|---|---|
| Emulsion | AgI content (%) | Feature of grain | Average grain diameter in terms of sphere (μm) | Fluctuation coefficient (%) | Feature of grain | Average grain diameter in terms of sphere (μm) | Fluctuation coefficient (%) |
| A | 3.7 | Monodisperse, cubic | 0.21 | 10 | Monodisperse, cubic | 0.20 | 10 |
| B | 3.3 | " | 0.38 | 11 | " | 0.35 | 10 |
| C | 5.0 | " | 0.56 | 14 | " | 0.50 | 16 |
| D | 2.0 | Polydisperse, tabular<br>Average aspect ratio: 2.5 | 1.21 | 26 | Polydisperse, tabular<br>Average aspect ratio: 2.5 | 1.00 | 25 |
| E | 4.0 | Monodisperse, cubic | 0.15 | 17 | Monodisperse, cubic | 0.15 | 17 |
| F | 4.0 | " | 0.27 | 17 | " | 0.25 | 16 |
| G | 3.5 | " | 0.38 | 11 | " | 0.35 | 11 |
| H | 3.5 | " | 0.56 | 11 | " | 0.50 | 9 |
| I | 2.5 | Polydisperse, tabular<br>Average aspect ratio: 3.0 | 0.93 | 24 | Polydisperse, tabular<br>Average aspect ratio: 3.0 | 0.80 | 26 |
| J | 1.5 | Polydisperse, tabular<br>Average aspect ratio: 9.0 | 1.50 | 27 | Polydisperse, tabular<br>Average aspect ratio: 9.0 | 1.30 | 28 |
| K | 4.0 | Monodisperse, cubic | 0.31 | 16 | Monodisperse, cubic | 0.30 | 16 |
| L | 4.0 | " | 0.49 | 17 | " | 0.45 | 17 |
| M | 3.5 | Polydisperse, tabular<br>Average aspect ratio: 4.0 | 0.66 | 27 | Polydisperse, tabular<br>Average aspect ratio: 4.0 | 0.60 | 26 |
| N | 2.5 | Polydisperse, tabular<br>Average aspect ratio: 10.0 | 1.12 | 29 | Polydisperse, tabular<br>Average aspect ratio: 10.0 | 1.00 | 28 |
| O | 2.0 | Polydisperse, internally high iodine type, twin | 2.10 | 37 | Polydisperse, internally high iodine type, twin | 1.90 | 33 |

| | | Specimen 107 | |
|---|---|---|---|
| Emulsion | Feature of grain | Average grain diameter in terms of sphere (μm) | Fluctuation coefficient (%) |
| A | Monodisperse, cubic | 0.20 | 10 |
| B | " | 0.35 | 10 |
| C | " | 0.50 | 14 |
| D | " | 0.86 | 15 |
| E | " | 0.15 | 17 |
| F | " | 0.25 | 16 |
| G | " | 0.35 | 11 |
| H | " | 0.50 | 9 |
| I | " | 0.75 | 14 |
| J | " | 0.86 | 15 |
| K | " | 0.30 | 16 |
| L | " | 0.45 | 17 |
| M | Polydisperse, tabular<br>Average aspect ratio: 4.0 | 0.60 | 26 |
| N | Polydisperse, tabular<br>Average aspect ratio: 10.0 | 1.00 | 26 |
| O | Polydisperse, internally high iodine type, twin | 1.40 | 37 |

TABLE 6

| | | Specimen 108 | | | Specimen 109 | | |
|---|---|---|---|---|---|---|---|
| Emulsion | AgI content (%) | Feature of grain | Average grain diameter in terms of sphere (μm) | Fluctuation coefficient (%) | Feature of grain | Average grain diameter in terms of sphere (μm) | Fluctuation coefficient (%) |

TABLE 6-continued

| | | Specimen 108 | | | Specimen 109 | | |
|---|---|---|---|---|---|---|---|
| A | 3.7 | Monodisperse, cubic | 0.19 | 10 | Monodisperse, cubic | 0.20 | 10 |
| B | 3.3 | " | 0.31 | 10 | " | 0.33 | 11 |
| C | 5.0 | " | 0.42 | 14 | " | 0.46 | 14 |
| D | 2.0 | Polydisperse, tabular Average aspect ratio: 2.5 | 0.08 | 25 | Polydisperse, tabular Average aspect ratio: 2.5 | 1.07 | 24 |
| E | 4.0 | Monodisperse, cubic | 0.14 | 17 | Monodisperse, cubic | 0.15 | 17 |
| F | 4.0 | " | 0.24 | 16 | " | 0.24 | 17 |
| G | 3.5 | " | 0.31 | 11 | " | 0.33 | 11 |
| H | 3.5 | " | 0.42 | 9 | " | 0.45 | 11 |
| I | 2.5 | Polydisperse, tabular Average aspect ratio: 3.0 | 0.69 | 24 | Polydisperse, tabular Average aspect ratio: 3.0 | 0.86 | 22 |
| J | 1.5 | Polydisperse, tabular Average aspect ratio: 9.0 | 1.03 | 28 | Polydisperse, tabular Average aspect ratio: 9.0 | 1.39 | 27 |
| K | 4.0 | Monodisperse, cubic | 0.29 | 16 | Monodisperse, cubic | 0.29 | 16 |
| L | 4.0 | " | 0.41 | 17 | " | 0.43 | 17 |
| M | 3.5 | Polydisperse, tabular Average aspect ratio: 4.0 | 0.52 | 26 | Polydisperse, tabular Average aspect ratio: 4.0 | 0.56 | 27 |
| N | 2.5 | Polydisperse, tabular Average aspect ratio: 10.0 | 0.85 | 26 | Polydisperse, tabular Average aspect ratio: 10.0 | 0.92 | 28 |
| O | 2.0 | Polydisperse, internally high iodine type, twin | 1.51 | 37 | Polydisperse, internally high iodine type, twin | 2.00 | 36 |

| | | Specimen 110 | | |
|---|---|---|---|---|
| Emulsion | Feature of grain | | Average grain diameter in terms of sphere (μm) | Fluctuation coefficient (%) |
| A | Monodisperse, cubic | | 0.21 | 10 |
| B | " | | 0.38 | 11 |
| C | " | | 0.56 | 14 |
| D | Polydisperse, tabular Average aspect ratio: 2.5 | | 1.12 | 22 |
| E | Monodisperse, cubic | | 0.15 | 17 |
| F | " | | 0.27 | 17 |
| G | " | | 0.38 | 11 |
| H | " | | 0.56 | 11 |
| I | Polydisperse, tabular Average aspect ratio: 3.0 | | 0.93 | 24 |
| J | Polydisperse, tabular Average aspect ratio: 9.0 | | 1.39 | 22 |
| K | Monodisperse, cubic | | 0.31 | 16 |
| L | " | | 0.49 | 17 |
| M | Polydisperse, tabular Average aspect ratio: 4.0 | | 0.66 | 27 |
| N | Polydisperse, tabular Average aspect ratio: 10.0 | | 1.12 | 29 |
| O | Polydisperse, internally high iodine type, twin | | 1.94 | 31 |

TABLE 7

| | | Specimen 111 | | | Specimen 112 | | |
|---|---|---|---|---|---|---|---|
| Emulsion | AgI content (%) | Feature of grain | Average grain diameter in terms of sphere (μm) | Fluctuation coefficient (%) | Feature of grain | Average grain diameter in terms of sphere (μm) | Fluctuation coefficient (%) |
| A | 3.7 | Monodisperse, cubic | 0.21 | 10 | Monodisperse, cubic | 0.21 | 10 |
| B | 3.3 | " | 0.38 | 11 | " | 0.38 | 11 |
| C | 5.0 | " | 0.56 | 14 | " | 0.56 | 14 |
| D | 2.0 | Polydisperse, tabular Average aspect ratio: 2.5 | 1.33 | 35 | Polydisperse, tabular Average aspect ratio: 14.0 | 0.80 | 8 |
| D' | | | | | " | 1.21 | 9 |
| E | 4.0 | Monodisperse, cubic | 0.15 | 17 | Monodisperse, cubic | 0.15 | 17 |
| F | 4.0 | " | 0.27 | 17 | " | 0.27 | 17 |
| G | 3.5 | " | 0.38 | 11 | " | 0.38 | 11 |
| H | 3.5 | " | 0.56 | 11 | " | 0.56 | 11 |
| I | 2.5 | Polydisperse, tabular | 0.96 | 34 | Monodisperse, tabular | 0.81 | 8 |

TABLE 7-continued

| | | | | | | | |
|---|---|---|---|---|---|---|---|
| | | Average aspect ratio: 3.0 | | | Average aspect ratio: 14.0 | | |
| J | 1.5 | Polydisperse, tabular<br>Average aspect ratio: 9.0 | 1.60 | 36 | " | 1.40 | 9 |
| K | 4.0 | Monodisperse, cubic | 0.31 | 16 | Monodisperse, cubic | 0.31 | 16 |
| L | 4.0 | " | 0.49 | 17 | " | 0.49 | 17 |
| M | 3.5 | Polydisperse, tabular<br>Average aspect ratio: 4.0 | 0.66 | 27 | Monodisperse, tabular<br>Average aspect ratio: 14.0 | 0.60 | 8 |
| N | 2.5 | Polydisperse, tabular<br>Average aspect ratio: 10.0 | 1.12 | 29 | " | 1.00 | 8 |
| O | 2.0 | Polydisperse, internally high iodine type, twin | 2.30 | 37 | Polydisperse, internally high iodine type, twin | 2.10 | 37 |

| | | Specimen 113 | |
|---|---|---|---|
| Emulsion | Feature of grain | Average grain diameter in terms of sphere (μm) | Fluctuation coefficient (%) |
| A | Monodisperse, cubic | 0.21 | 10 |
| B | " | 0.38 | 11 |
| C | " | 0.56 | 14 |
| D | Polydisperse, tabular<br>Average aspect ratio: 2.5 | 1.21 | 26 |
| D' | | | |
| E | Monodisperse, cubic | 0.15 | 17 |
| F | " | 0.27 | 17 |
| G | " | 0.38 | 11 |
| H | " | 0.56 | 11 |
| I | Polydisperse, tabular<br>Average aspect ratio: 3.0 | 0.93 | 24 |
| J | Polydisperse, tabular<br>Average aspect ratio: 9.0 | 1.50 | 27 |
| K | Monodisperse, cubic | 0.31 | 16 |
| L | " | 0.49 | 17 |
| M | Polydisperse, tabular<br>Average aspect ratio: 4.0 | 0.66 | 27 |
| N | Polydisperse, tabular<br>Average aspect ratio: 10.0 | 1.12 | 29 |
| O | Polydisperse, internally high iodine type, twin | 2.10 | 37 |

TABLE 8

| | | Specimen 114 | | |
|---|---|---|---|---|
| Emulsion | AgI content (%) | Feature of grain | Average grain diameter in terms of sphere (μm) | Fluctuation coefficient (%) |
| A | 3.7 | Monodisperse cubic | 0.21 | 10 |
| B | 3.3 | " | 0.38 | 11 |
| C | 5.0 | " | 0.56 | 14 |
| D | 2.0 | Polydisperse tabular<br>Average aspect ratio: 2.5 | 1.21 | 26 |
| E | 4.0 | Monodisperse cubic | 0.15 | 17 |
| F | 4.0 | " | 0.27 | 17 |
| G | 3.5 | " | 0.38 | 11 |
| H | 3.5 | " | 0.56 | 11 |
| I | 2.5 | Polydisperse tabular<br>Average aspect ratio: 3.0 | 0.93 | 24 |
| J | 1.5 | Polydisperse tabular<br>Average aspect ratio: 9.0 | 1.50 | 27 |
| K | 4.0 | Monodisperse cubic | 0.31 | 16 |
| L | 4.0 | " | 0.49 | 17 |
| M | 3.5 | Polydisperse tabular<br>Average aspect ratio: 4.0 | 0.66 | 27 |
| N | 2.5 | Polydisperse tabular<br>Average aspect ratio: 10.0 | 1.12 | 29 |
| O | 2.0 | Polydisperse internally high iodine type, twin | 2.10 | 37 |

TABLE 8-continued

The coated amounts of the various emulsions in the various layers in Specimens 101 to 114 as calculated in terms of silver are as follows:

TABLE 9

| Layer | Emulsion | Specimens 101–105 (g/m²) | Specimens 106–112 (g/m²) | Specimen 113 (g/m²) | Specimen 114 (g/m²) |
|---|---|---|---|---|---|
| 4th layer | A | 0.50 | 0.50 | 0.65 | 0.50 |
| | B | 0.30 | 0.31 | 0.16 | 0.31 |
| 5th layer | B | 0.20 | 0.22 | 0.11 | 0.56 |
| | C | 0.30 | 0.34 | 0.45 | — |
| 6th layer | D | 0.40 | 0.47*) | 0.47 | 0.47 |
| 9th layer | E | 0.30 | 0.30 | 0.45 | 0.30 |

TABLE 9-continued

| Layer | Emulsion | Specimens 101–105 (g/m²) | Specimens 106–112 (g/m²) | Specimen 113 (g/m²) | Specimen 114 (g/m²) |
|---|---|---|---|---|---|
| | F | 0.30 | 0.31 | 0.16 | 0.31 |
| | G | 0.30 | 0.33 | 0.33 | 0.33 |
| 10th layer | G | 0.30 | 0.32 | 0.16 | 0.32 |
| | H | 0.20 | 0.22 | 0.38 | 0.22 |
| 11th layer | I | 0.30 | 0.33 | 0.33 | 0.16 |
| | J | 0.20 | 0.24 | 0.24 | 0.41 |
| 15th layer | K | 0.40 | 0.40 | 0.60 | 0.40 |
| | L | 0.40 | 0.40 | 0.20 | 0.40 |
| 16th layer | M | 0.20 | 0.21 | 0.41 | 0.37 |
| | N | 0.30 | 0.33 | 0.13 | 0.17 |
| 17th layer | O | 0.40 | 0.45 | 0.45 | 0.45 |

*)For Specimen 112, Emulsion D consists of two emulsions D (0.27 g/m²) and D' (0.20 g/m²).

Specimens 101 to 114 thus prepared were then subjected to exposure and development in accordance with the foregoing method for determining the characteristic curve to obtain characteristic curves for R, G and B. From these characteristic curves, point gamma, Dmin, and Dmax were obtained. The results are set forth in Tables 10 and 11.

TABLE 10

| Specimen | | A value | Point gamma (D = 0.5 to 1.5) Fluctuation coefficient (%) | B value | Point gamma (D = 1.5 to Dmax) Fluctuation coefficient (%) | Dmin | Dmax | B/A | Remarks |
|---|---|---|---|---|---|---|---|---|---|
| 101 | B | 1.0 | 11.5 | 1.2 | 12.5 | 0.09 | 2.9 | 1.20 | Comparison |
| | G | 1.0 | 9.5 | 1.2 | 11.0 | 0.09 | 2.9 | 1.20 | |
| | R | 1.0 | 9.0 | 1.2 | 10.0 | 0.09 | 2.8 | 1.20 | |
| 102 | B | 1.0 | 11.0 | 1.8 | 12.5 | 0.08 | 2.9 | 1.80 | " |
| | G | 1.0 | 10.0 | 1.8 | 11.0 | 0.08 | 2.9 | 1.80 | |
| | R | 1.0 | 10.3 | 1.8 | 10.5 | 0.08 | 2.8 | 1.80 | |
| 103 | B | 1.2 | 11.8 | 1.3 | 12.5 | 0.08 | 2.9 | 1.08 | " |
| | G | 1.2 | 10.5 | 1.3 | 11.5 | 0.08 | 2.9 | 1.08 | |
| | R | 1.2 | 9.5 | 1.3 | 10.3 | 0.08 | 2.8 | 1.08 | |
| 104 | B | 1.1 | 11.5 | 1.0 | 12.6 | 0.08 | 2.9 | 0.91 | " |
| | G | 1.1 | 9.8 | 1.0 | 11.1 | 0.08 | 2.9 | 0.91 | |
| | R | 1.1 | 9.3 | 1.0 | 10.5 | 0.08 | 2.8 | 0.91 | |
| 105 | B | 0.9 | 12.5 | 1.1 | 13.8 | 0.08 | 2.9 | 1.22 | " |
| | G | 0.9 | 11.0 | 1.1 | 12.3 | 0.08 | 2.9 | 1.22 | |
| | R | 0.9 | 11.2 | 1.1 | 12.9 | 0.08 | 2.8 | 1.22 | |
| 106 | B | 1.1 | 11.8 | 1.3 | 12.8 | 0.11 | 3.3 | 1.18 | " |
| | G | 1.1 | 9.7 | 1.3 | 11.3 | 0.11 | 3.3 | 1.18 | |
| | R | 1.1 | 9.1 | 1.3 | 10.1 | 0.11 | 3.2 | 1.18 | |
| 107 | B | 1.1 | 11.2 | 1.9 | 12.9 | 0.09 | 3.3 | 1.73 | " |
| | G | 1.1 | 10.1 | 1.9 | 11.6 | 0.09 | 3.3 | 1.73 | |
| | R | 1.1 | 10.5 | 1.9 | 10.8 | 0.09 | 3.2 | 1.73 | |
| 108 | B | 1.3 | 12.0 | 1.4 | 12.9 | 0.09 | 3.3 | 1.08 | " |
| | G | 1.3 | 10.9 | 1.4 | 11.7 | 0.09 | 3.3 | 1.08 | |
| | R | 1.3 | 9.7 | 1.4 | 10.8 | 0.09 | 3.2 | 1.08 | |

TABLE 11

| Point gamma (D = 0.5 to 1.5) Fluctuation | Point gamma (D = 1.5 to Dmax) Fluctuation |
|---|---|

| Specimen | | A value | coeffi-cient (%) | B value | coeffi-cient (%) | Dmin | Dmax | B/A | Remarks |
|---|---|---|---|---|---|---|---|---|---|
| 109 | B | 1.2 | 11.7 | 1.1 | 12.8 | 0.09 | 3.3 | 0.91 | Comparison |
| | G | 1.2 | 9.9 | 1.1 | 11.5 | 0.09 | 3.3 | 0.91 | |
| | R | 1.2 | 9.7 | 1.1 | 10.8 | 0.09 | 3.2 | 0.91 | |
| 110 | B | 1.0 | 12.7 | 1.4 | 14.1 | 0.09 | 3.3 | 1.40 | Invention |
| | G | 1.0 | 11.5 | 1.4 | 13.8 | 0.09 | 3.3 | 1.40 | |
| | R | 1.0 | 11.6 | 1.4 | 13.3 | 0.09 | 3.2 | 1.40 | |
| 111 | B | 1.0 | 11.4 | 1.2 | 12.3 | 0.09 | 3.3 | 1.20 | " |
| | G | 1.0 | 9.6 | 1.2 | 10.9 | 0.09 | 3.3 | 1.20 | |
| | R | 1.0 | 9.1 | 1.2 | 10.3 | 0.09 | 3.2 | 1.20 | |
| 112 | B | 1.0 | 11.3 | 1.2 | 11.2 | 0.08 | 3.3 | 1.20 | " |
| | G | 1.0 | 9.7 | 1.2 | 9.9 | 0.08 | 3.3 | 1.20 | |
| | R | 1.0 | 9.3 | 1.2 | 9.5 | 0.08 | 3.2 | 1.20 | |
| 113 | B | 1.0 | 28.3 | 1.2 | 14.5 | 0.09 | 3.3 | 1.20 | Comparison |
| | G | 1.0 | 25.9 | 1.2 | 14.3 | 0.09 | 3.3 | 1.20 | |
| | R | 1.0 | 25.3 | 1.2 | 14.3 | 0.09 | 3.2 | 1.20 | |
| 114 | B | 1.0 | 14.9 | 1.2 | 19.8 | 0.09 | 3.3 | 1.20 | " |
| | G | 1.0 | 14.2 | 1.2 | 18.3 | 0.09 | 3.3 | 1.20 | |
| | R | 1.0 | 14.4 | 1.2 | 17.5 | 0.09 | 3.2 | 1.20 | |

In order to evaluate the tone reproducibility of these specimens with respect to the transparency original, the same transparency and reflective originals were printed on these specimens. As the transparency original there was used a color slide prepared from Fuji Chrome Professional Reversal Film (RDP) (available from Fuji Photo Film Co., Ltd.).

The density of various points in a predetermined linear zone on the original and the corresponding prints were measured. The density value measured at several typical points are set forth in Table 12.

In Table 12, the density of measuring points a to h on the transparency original and the print density of points on Specimens 101 to 114 on which the original has been printed which points correspond to the points a to h respectively are given. These points actually correspond to the following objects:

a: dark background; b: gray chart 1; c: gray chart 2; d: gray chart 3; e: shadow on face; f: highlight on face; g: shadow on shirt; h: highlight on shirt

TABLE 12

Tone reproducibility of print with respect to transparency original

| | Yellow density | | | | | | | | Magenta density | | | | | | | |
|---|---|---|---|---|---|---|---|---|---|---|---|---|---|---|---|---|
| | a | b | c | d | e | f | g | h | a | b | c | d | e | f | g | h |
| Original | 2.75 | 1.60 | 1.20 | 0.90 | 0.63 | 0.40 | 0.25 | 0.14 | 2.81 | 1.75 | 1.33 | 1.04 | 0.67 | 0.42 | 0.33 | 0.14 |
| Specimen 101 | 2.60 | 1.45 | 0.95 | 0.56 | 0.38 | 0.24 | 0.20 | 0.14 | 2.57 | 1.70 | 1.15 | 0.92 | 0.48 | 0.31 | 0.25 | 0.17 |
| Specimen 102 | 2.90 | 1.45 | 0.95 | 0.56 | 0.38 | 0.24 | 0.20 | 0.14 | 2.90 | 1.82 | 1.15 | 0.92 | 0.48 | 0.31 | 0.25 | 0.17 |
| Specimen 103 | 2.90 | 1.65 | 1.10 | 0.65 | 0.45 | 0.28 | 0.22 | 0.14 | 2.90 | 2.03 | 1.35 | 1.08 | 0.55 | 0.36 | 0.27 | 0.17 |
| Specimen 104 | 2.52 | 1.56 | 1.04 | 0.60 | 0.40 | 0.26 | 0.21 | 0.14 | 2.50 | 1.78 | 1.25 | 1.00 | 0.51 | 0.33 | 0.25 | 0.17 |
| Specimen 105 | 2.35 | 1.30 | 0.85 | 0.50 | 0.36 | 0.24 | 0.20 | 0.14 | 2.33 | 1.50 | 1.05 | 0.82 | 0.45 | 0.31 | 0.25 | 0.17 |
| Specimen 106 | 3.30 | 1.64 | 1.05 | 0.61 | 0.41 | 0.29 | 0.26 | 0.16 | 3.30 | 1.88 | 1.25 | 1.01 | 0.53 | 0.33 | 0.26 | 0.19 |
| Specimen 107 | 3.30 | 1.64 | 1.05 | 0.61 | 0.41 | 0.29 | 0.21 | 0.14 | 3.30 | 2.01 | 1.25 | 1.01 | 0.53 | 0.33 | 0.26 | 0.17 |
| Specimen 108 | 3.30 | 1.91 | 1.22 | 0.73 | 0.48 | 0.38 | 0.30 | 0.16 | 3.30 | 2.25 | 1.50 | 1.19 | 0.60 | 0.38 | 0.30 | 0.17 |
| Specimen 109 | 2.86 | 1.73 | 1.10 | 0.66 | 0.45 | 0.29 | 0.23 | 0.15 | 2.92 | 2.00 | 1.36 | 1.10 | 0.56 | 0.36 | 0.29 | 0.17 |
| Specimen 110 | 2.84 | 1.63 | 1.10 | 0.73 | 0.50 | 0.33 | 0.24 | 0.14 | 2.91 | 1.92 | 1.30 | 1.01 | 0.60 | 0.40 | 0.30 | 0.17 |
| Specimen 111 | 2.72 | 1.60 | 1.10 | 0.73 | 0.50 | 0.33 | 0.24 | 0.14 | 2.79 | 1.71 | 1.30 | 1.01 | 0.60 | 0.40 | 0.30 | 0.17 |
| Specimen 112 | 2.72 | 1.60 | 1.10 | 0.73 | 0.50 | 0.33 | 0.24 | 0.14 | 2.79 | 1.71 | 1.30 | 1.01 | 0.60 | 0.39 | 0.29 | 0.15 |
| Specimen 113 | 2.85 | 1.65 | 1.28 | 0.61 | 0.59 | 0.31 | 0.17 | 0.14 | 2.91 | 1.91 | 1.49 | 0.83 | 0.71 | 0.49 | 0.21 | 0.16 |
| Specimen 114 | 2.85 | 1.93 | 1.15 | 0.70 | 0.50 | 0.33 | 0.24 | 0.14 | 2.92 | 2.23 | 1.30 | 1.01 | 0.60 | 0.40 | 0.30 | 0.17 |

| | Cyan density | | | | | | | | |
|---|---|---|---|---|---|---|---|---|---|
| | a | b | c | d | e | f | g | h | Remarks |
| Original | 2.80 | 1.81 | 1.38 | 1.10 | 0.42 | 0.28 | 0.30 | 0.12 | Comparison |
| Specimen 101 | 2.65 | 1.72 | 1.05 | 0.94 | 0.28 | 0.23 | 0.23 | 0.14 | " |
| Specimen 102 | 2.76 | 1.91 | 1.05 | 0.94 | 0.28 | 0.23 | 0.23 | 0.14 | " |
| Specimen 103 | 2.76 | 2.03 | 1.25 | 1.10 | 0.32 | 0.25 | 0.25 | 0.14 | " |
| Specimen 104 | 2.56 | 1.73 | 1.14 | 1.02 | 0.32 | 0.24 | 0.24 | 0.14 | " |
| Specimen 105 | 2.36 | 1.54 | 0.95 | 0.86 | 0.26 | 0.22 | 0.22 | 0.14 | " |
| Specimen 106 | 3.20 | 1.90 | 1.16 | 1.04 | 0.30 | 0.24 | 0.24 | 0.16 | " |
| Specimen 107 | 3.20 | 2.02 | 1.16 | 1.04 | 0.30 | 0.23 | 0.23 | 0.14 | " |
| Specimen 108 | 3.20 | 2.26 | 1.36 | 1.22 | 0.36 | 0.26 | 0.26 | 0.14 | " |
| Specimen 109 | 2.93 | 2.01 | 1.23 | 1.12 | 0.33 | 0.25 | 0.25 | 0.14 | " |
| Specimen 110 | 2.83 | 1.88 | 1.31 | 1.07 | 0.41 | 0.27 | 0.29 | 0.14 | Invention |
| Specimen 111 | 2.77 | 1.77 | 1.31 | 1.07 | 0.41 | 0.27 | 0.29 | 0.14 | " |
| Specimen 112 | 2.77 | 1.77 | 1.31 | 1.07 | 0.41 | 0.26 | 0.28 | 0.13 | " |
| Specimen 113 | 2.92 | 1.92 | 1.44 | 0.93 | 0.49 | 0.19 | 0.19 | 0.14 | Comparison |

TABLE 12-continued

| Tone reproducibility of print with respect to transparency original | | | | | | | | | |
|---|---|---|---|---|---|---|---|---|---|
| Specimen 114 | 2.90 | 2.11 | 1.31 | 1.07 | 0.41 | 0.27 | 0.29 | 0.14 | " |

A transparent photographic material which is adapted to form a color transparency directly from a transparency is required to reproduce the tone of the original as faithfully as possible. To this end, it is desired to faithfully reproduce the density, particularly density difference of the original. Table 12 makes the following points clear. That is, the comparative photographic light-sensitive materials provide a good reproduction of some of the points a to h (e.g., only shadow, only half tone, only highlight) but a poor reproduction of the other points. On the other hand, the photographic light-sensitive materials of the present invention provide a good reproduction of all the points a to h. It can be further seen that Specimen 111, which exhibits B/A value of 1.2, provides a better reproduction of shadow than Specimen 110.

EXAMPLE 2

Preparation of Emulsions A-a to Emulsion A-c

Silver bromoiodide grains having a grain diameter of 0.26 μm as calculated in terms of sphere and a variation coefficient of 10% were obtained in the same manner as Emulsion A except that the temperature at which grains are formed was altered. The emulsion was then subjected to chemical sensitization with an optimum amount of sodium thiosulfate, chloroauric acid, potassium thiocyanate and sodium benzenethiosulfonateo Compound (I-9) was added to the emulsion at the end of the chemical sensitization. After 10 minutes, a spectral sensitizing dye S-1 was added to the emulsion to obtain Emulsion A-a. The amount of Compound (I-9) added was $2.7\times10^{-3}$ mol per mol of silver halide. The amount of the spectral sensitizing dye S-1 added was 0.11 g per mol of silver halide. Emulsions A-b and A-c were prepared in the same manner as Emulsion A-a except that Compound (I-17) and Compound (I-38) were added instead of Compound (I-9) in the same manner in the same amount, respectively. The feature of these emulsions are set forth in Table 13.

Preparation of Emulsions E-a to E-c and Emulsions K-a to K-c

Emulsions E-a to E-c and Emulsions K-a to K-c were prepared in a manner similar to Emulsions A-a to A-c. The feature of these emulsions are set forth in Table 13.

Preparation of Emulsions B-a, G-a and M-a

Emulsions B-a, G-a and M-a were prepared in a manner similar to Emulsion A-b. The feature of these emulsions are set forth in Table 13.

TABLE 13

| Emulsion | Size (μm) | Variation coefficient (%) | Compound Name | Compound Amount added (mol/mol Ag) | Sensitizing dye Type | Sensitizing dye Amount added (g/mol Ag) |
|---|---|---|---|---|---|---|
| A | 0.21 | 10 | — | — | S-1 | 0.35 |
| A-a | 0.26 | 10 | (I-9) | $2.7\times10^{-3}$ | S-1 | 0.11 |
| A-b | 0.26 | 10 | (I-17) | $2.7\times10^{-3}$ | S-1 | 0.11 |
| A-c | 0.26 | 10 | (I-38) | $2.7\times10^{-3}$ | S-1 | 0.11 |
| B | 0.38 | 10 | — | | S-1 | 0.20 |
| B-a | 0.48 | 10 | (I-17) | $1.8\times10^{-3}$ | S-1 | 0.06 |
| E | 0.15 | 17 | — | — | S-2 | 0.50 |
| | | | | | S-4 | 0.10 |
| E-a | 0.20 | 17 | (I-9) | $3.5\times10^{-3}$ | S-2 | 0.27 |
| | | | | | S-4 | 0.05 |
| E-b | 0.20 | 17 | (I-17) | $3.5\times10^{-3}$ | S-2 | 0.27 |
| | | | | | S-4 | 0.05 |
| E-c | 0.20 | 17 | (I-38) | $3.5\times10^{-3}$ | S-2 | 0.27 |
| | | | | | S-4 | 0.05 |
| G | 0.38 | 11 | — | — | S-2 | 0.25 |
| | | | | | S-4 | 0.04 |
| G-a | 0.47 | 11 | (I-17) | $2.0\times10^{-3}$ | S-2 | 0.14 |
| | | | | | S-4 | 0.02 |
| K | 0.31 | 16 | — | — | S-6 | 0.15 |
| K-a | 0.39 | 16 | (I-9) | $1.8\times10^{-3}$ | S-6 | 0.07 |
| K-b | 0.39 | 16 | (I-17) | $1.8\times10^{-3}$ | S-6 | 0.07 |
| K-c | 0.39 | 16 | (I-38) | $1.8\times10^{-3}$ | S-6 | 0.07 |
| M | 0.66 | 26 | — | — | S-6 | 0.15 |
| M-a | 0.83 | 28 | (I-17) | $8.4\times10^{-4}$ | S-6 | 0.07 |

Preparation of Specimen 201 to 203

Specimens 201 to 203 were prepared in the same manner as Specimen 111 except that Emulsion A to be incorporated in the 4th layer in Specimen 111 was replaced by Emulsions A-a to A-c shown above, Emulsions E to be incorporated in the 9th layer in Specimen 111 was replaced by Emulsions E-a to E-c shown above, and Emulsion K to be incorporated in the 15th layer in Specimen 111 was replaced by Emulsions K-a to K-c shown above, respectively.

Preparation of Specimen 204

Specimen 204 was prepared in the same manner as Specimen 111 except that Emulsion B to be incorporated in the 5th layer in Specimen 111 was replaced by Emulsion B-a shown above, Emulsion G to be incorporated in the 9th layer in Specimen 111 was replaced by Emulsion G-a shown above, and Emulsion K to be incorporated in the 15th layer in Specimen 111 was replaced by Emulsion K-a shown above, respectively.

Preparation of Specimen 205

Specimen 205 was prepared in the same manner as Specimen 202 except that Emulsion B to be incorporated in the 5th layer in Specimen 202 was replaced by Emulsion B-a shown above, Emulsion G to be incorporated in the 9th layer in Specimen 202 was replaced by Emulsion G-a shown above, and Emulsion K to be incorporated in the 15th layer in Specimen 202 was replaced by Emulsion K-a shown above, respectively.

The emulsions used in the various layers in Specimen 111 and Specimens 201 to 205 are set forth in Table 14.

TABLE 14

| | Sample 111 (Comparison) | | | Sample 201 (Invention) | | | Sample 202 (Invention) | | |
|---|---|---|---|---|---|---|---|---|---|
| | Emulsion | Size (μm) | Compound | Emulsion | Size (μm) | Compound | Emulsion | Size (μm) | Compound |
| 4th | A | 0.21 | — | A-a | 0.20 | (I-9) | A-b | 0.20 | (I-17) |
| Layer | B | 0.38 | — | B | 0.38 | — | B | 0.38 | — |
| 5th | B | 0.38 | — | B | 0.38 | — | B | 0.38 | — |
| Layer | C | 0.56 | — | C | 0.56 | — | C | 0.56 | — |
| 9th | E | 0.15 | — | E-a | 0.20 | (I-9) | E-b | 0.20 | (I-17) |
| Layer | F | 0.27 | — | F | 0.27 | — | F | 0.27 | — |
| | G | 0.38 | — | G | 0.38 | — | G | 0.38 | — |
| 10th | G | 0.38 | — | G | 0.38 | — | G | 0.38 | — |
| Layer | H | 0.56 | — | H | 0.56 | — | H | 0.56 | — |
| 15th | K | 0.31 | — | K-a | 0.39 | (I-9) | K-b | 0.39 | (I-17) |
| Layer | L | 0.49 | — | L | 0.49 | — | L | 0.49 | — |
| 16th | M | 0.66 | — | M | 0.66 | — | M | 0.66 | — |
| Layer | N | 1.12 | — | N | 1.12 | — | N | 1.12 | — |

| | Sample 203 (Invention) | | | Sample 204 (Invention) | | | Sample 205 (Invention) | | |
|---|---|---|---|---|---|---|---|---|---|
| | Emulsion | Size (μm) | Compound | Emulsion | Size (μm) | Compound | Emulsion | Size (μm) | Compound |
| 4th | A-c | 0.20 | (I-38) | A | 0.21 | — | A-b | 0.26 | (I-17) |
| Layer | B | 0.38 | — | B | 0.38 | — | B | 0.38 | — |
| 5th | B | 0.38 | — | B-a | 0.48 | (I-17) | B-a | 0.48 | (I-17) |
| Layer | C | 0.56 | — | C | 0.56 | — | C | 0.56 | — |
| 9th | E-c | 0.20 | (I-38) | E | 0.15 | — | E-b | 0.20 | (I-17) |
| Layer | F | 0.27 | — | F | 0.27 | — | F | 0.27 | — |
| | G | 0.38 | — | G | 0.38 | — | G | 0.38 | — |
| 10th | G | 0.38 | — | G-a | 0.47 | (I-17) | G-a | 0.47 | (I-17) |
| Layer | H | 0.56 | — | H | 0.56 | — | H | 0.56 | — |
| 15th | K-c | 0.39 | (I-38) | K | 0.31 | — | K-b | 0.31 | (I-17) |
| Layer | L | 0.49 | — | L | 0.49 | — | L | 0.49 | — |
| 16th | M | 0.66 | — | M-a | 0.83 | (I-17) | M-a | 0.83 | (I-17) |
| Layer | N | 1.12 | — | N | 1.12 | — | H | 0.56 | — |

Specimens 201 to 205 thus prepared were then subjected to exposure and development in accordance with the foregoing method for determining the characteristic curve to obtain characteristic curves for R, G and B. From these characteristic curves, point gamma, Dmin and Dmax were obtained. The results are set forth in Table 15.

TABLE 15

| Specimen | | A value | Fluctuation coefficient (%) | B value | Fluctuation coefficient (%) | Dmin | Dmax | B/A | Remarks |
|---|---|---|---|---|---|---|---|---|---|
| | | Point gamma (D = 0.5 to 1.5) | | Point gamma (D = 1.5 to Dmax) | | | | | |
| 101 | B | 1.0 | 11.5 | 1.2 | 12.5 | 0.09 | 2.9 | 1.20 | Comparison |
| | G | 1.0 | 9.5 | 1.2 | 11.0 | 0.09 | 2.9 | 1.20 | |
| | R | 1.0 | 9.0 | 1.2 | 10.0 | 0.09 | 2.8 | 1.20 | |
| 111 | B | 1.0 | 11.4 | 1.2 | 12.3 | 0.09 | 3.3 | 1.20 | Invention |
| | G | 1.0 | 9.6 | 1.2 | 10.9 | 0.09 | 3.3 | 1.20 | |
| | R | 1.0 | 9.1 | 1.2 | 10.3 | 0.09 | 3.2 | 1.20 | |
| 201 | B | 1.0 | 10.7 | 1.2 | 12.2 | 0.08 | 3.3 | 1.20 | " |
| | G | 1.0 | 9.5 | 1.2 | 10.8 | 0.08 | 3.3 | 1.20 | |
| | R | 1.0 | 9.1 | 1.2 | 10.2 | 0.08 | 3.1 | 1.20 | |
| 202 | B | 1.0 | 10.1 | 1.2 | 12.1 | 0.07 | 3.3 | 1.20 | " |
| | G | 1.0 | 9.4 | 1.2 | 10.5 | 0.07 | 3.3 | 1.20 | |
| | R | 1.0 | 8.9 | 1.2 | 10.1 | 0.07 | 3.2 | 1.20 | |
| 203 | B | 1.0 | 10.8 | 1.2 | 12.2 | 0.08 | 3.3 | 1.20 | " |
| | G | 1.0 | 9.6 | 1.2 | 10.8 | 0.08 | 3.3 | 1.20 | |
| | R | 1.0 | 9.1 | 1.2 | 10.3 | 0.08 | 3.1 | 1.20 | |
| 204 | B | 1.0 | 10.6 | 1.2 | 12.2 | 0.08 | 3.3 | 1.20 | " |
| | G | 1.0 | 9.5 | 1.2 | 10.7 | 0.08 | 3.3 | 1.20 | |
| | R | 1.0 | 9.0 | 1.2 | 10.2 | 0.08 | 3.2 | 1.20 | |
| 205 | B | 1.0 | 9.7 | 1.2 | 10.1 | 0.07 | 3.3 | 1.20 | " |
| | G | 1.0 | 8.7 | 1.2 | 9.9 | 0.07 | 3.3 | 1.20 | |
| | R | 1.0 | 7.9 | 1.2 | 9.6 | 0.07 | 3.2 | 1.20 | |

Table 15 shows that Specimens 201 to 205 are excellent in point gamma and its variation coefficient and provide a low Dmin. It can also be seen that the use of Compound (I-17) gives better results.

EXAMPLE 3

Preparation of Emulsion A-d

An emulsion of $Rh^+$ ion-doped silver halide grains with a grain size of 0.36 μm and a variation coefficient of 10% was prepared in the same manner as Emulsion A except that to the potassium halide solution to be added during the formation of grains was added $K_3RhCl_6$ in an amount of $2.1\times10^{-7}$ mol/mol Ag and the temperature at which grains are formed was altered. The emulsion was then subjected to optimum chemical sensitization with an optimum amount of sodium thiosulfate, chloroauric acid, potassium thiocyanate and sodium benzenethiosulfonate to obtain Emulsion A-d.

Preparation of Emulsions B-b, E-d, G-b, K-d and M-b

Emulsions B-b, E-d, G-b, K-d and M-b were prepared on the basis of the grain formation of Emulsions B, E, G, K and M in the same manner as Emulsion A-d. The feature of these emulsions are set forth in Table 16.

Preparation of Emulsion A-e

Silver bromoiodide grains having a grain diameter of 0.36 μm as calculated in terms of sphere and a variation coefficient of 10% were obtained in the same manner as Emulsion E except that the temperature at which grains are formed was altered. The emulsion was then subjected to chemical sensitization with an optimum amount of sodium thiosulfate, chloroauric acid, potassium thiocyanate and sodium benzenethiosulfonate. Compound (I-17) was added to the emulsion at the end of the chemical sensitization. After 10 minutes, a spectral sensitizing dye S-1 was added to the emulsion to obtain Emulsion A-e. The amount of Compound (I-17) added was $2.9\times10^{-3}$ mol per mol of silver halide. The amount of the spectral sensitizing dye S-1 added was 0.024 g per mol of silver halide.

Preparation of Emulsions E-e and K-e

Emulsions E-e and K-e were prepared on the basis of the grain formation of Emulsions E and K in the same manner as Emulsion A-e, respectively. The feature of these emulsions are set forth in Table 16.

TABLE 16

| Emulsion | Size (μm) | Variation coefficient (%) | $Rh^{3+}$ Amount added (mol/mol Ag) | Sensitizing Dye Type | Sensitizing Dye Amount Added (g/mol Ag) |
|---|---|---|---|---|---|
| A | 0.21 | 10 | — | S-1 | 0.35 |
| A-d | 0.36 | 10 | $2.1\times10^{-7}$ | S-1 | 0.24 |
| A-e | 0.36 | 10 | — | S-1 | 0.02 |
| B | 0.38 | 10 | — | S-1 | 0.20 |
| B-b | 0.66 | 10 | $3.4\times10^{-8}$ | S-1 | 0.15 |
| E | 0.15 | 17 | — | S-2 | 0.50 |
| | | | | S-4 | 0.10 |
| E-d | 0.30 | 10 | $3.7\times10^{-7}$ | S-2 | 0.25 |
| | | | | S-4 | 0.05 |
| E-e | 0.30 | 10 | — | S-2 | 0.03 |
| | | | | S-4 | 0.01 |
| G | 0.38 | 11 | — | S-2 | 0.25 |
| | | | | S-4 | 0.04 |
| G-b | 0.55 | 17 | $6.0\times10^{-8}$ | S-2 | 0.17 |
| | | | | S-4 | 0.03 |
| K | 0.31 | 16 | — | S-6 | 0.15 |
| K-d | 0.53 | 17 | $6.7\times10^{-8}$ | S-6 | 0.09 |
| K-e | 0.53 | 17 | — | S-6 | 0.01 |
| M | 0.66 | 26 | — | S-6 | 0.15 |
| M-b | 1.14 | 17 | $1.0\times10^{-8}$ | S-6 | 0.08 |

Preparation of Specimen 301

Specimens 301 was prepared in the same manner as Specimen 111 except that Emulsion A to be incorporated in the 4th layer in Specimen 111 was replaced by Emulsion A-d, Emulsion E to be incorporated in the 9th layer in Specimen 11i was replaced by Emulsion E-d and Emulsion K to be incorporated in the 15th layer in Specimen 111 was replaced by Emulsion K-d, respectively.

Preparation of Specimen 302

Specimen 302 was prepared in the same manner as Specimen 111 except that Emulsion A to be incorporated in the 4th layer in Specimen 111 was replaced by Emulsion A-e, Emulsion E to be incorporated in the 9th layer in Specimen 111 was replaced by Emulsion E-e and Emulsion K to be incorporated in the 15th layer in Specimen 111 was replaced by Emulsion K-e, respectively.

Preparation of Specimen 303

Specimen 303 was prepared in the same manner as Specimen 111 except that Emulsion B to be incorporated in the 5th layer in Specimen 111 was replaced by Emulsion B-b, Emulsion G to be incorporated in the 10th layer in Specimen 111 was replaced by Emulsion G-b and Emulsion M to be incorporated in the 16th layer in Specimen 111 was replaced by Emulsion M-b, respectively.

Preparation of Specimen 304

Specimen 304 was prepared in the same manner as Specimen 301 except that Emulsion B to be incorporated in the th layer in Specimen 301 was replaced by Emulsion B-b, Emulsion G to be incorporated in the 10th layer in Specimen 301 was replaced by Emulsion G-b and Emulsion M to be incorporated in the 16th layer in Specimen 301 was replaced by Emulsion M-b, respectively.

The feature of these emulsions are set forth in Table 17.

TABLE 17

| | | Sample 101 (Comparison) | | | Sample 111 (Invention) | | | Sample 301 (Invention) | | |
|---|---|---|---|---|---|---|---|---|---|---|
| | | Emulsion | Size (μm) | $R_{2/1}$ | Emulsion | Size (μm) | $R_{2/1}$ | Emulsion | Size (μm) | $R_{2/1}$ |
| 4th Layer | Low-Sensitivity Emulsion 1 | A | 0.02 | 0.20 | A | 0.21 | 0.01 | A-d | 0.36 | 0.59 |
| | High-Sensitivity Emulsion 2 | B | 0.35 | | B | 0.38 | | B | 0.38 | |
| 5th Layer | Low-Sensitivity Emulsion 1 | B | 0.35 | 0.01 | B | 0.38 | 0.01 | B | 0.38 | 0.01 |
| | High-Sensitivity Emulsion 2 | C | 0.50 | | C | 0.56 | | C | 0.56 | |
| 9th Layer | Low-Sensitivity Emulsion 1 | E | 0.15 | | E | 0.15 | | E-d | 0.30 | |
| | Middle-Sensitivity Emulsion | F | 0.25 | 0.01 | F | 0.27 | 0.02 | F | 0.27 | 0.54 |
| | High-Sensitivity Emulsion 2 | G | 0.35 | | G | 0.38 | | G | 0.38 | |
| 10th Layer | Low-Sensitivity Emulsion 1 | G | 0.35 | 0.00 | G | 0.38 | 0.01 | G | 0.38 | 0.01 |
| | High-Sensitivity Emulsion 2 | H | 0.50 | | H | 0.56 | | H | 0.56 | |
| 15th Layer | Low-Sensitivity Emulsion 1 | K | 0.30 | 0.01 | K | 0.31 | 0.00 | K-d | 0.53 | 0.61 |
| | High-Sensitivity Emulsion 2 | L | 0.45 | | L | 0.49 | | L | 0.49 | |
| 16th Layer | Low-Sensitivity Emulsion 1 | M | 0.60 | 0.02 | M | 0.66 | 0.04 | M | 0.66 | 0.04 |
| | High-Sensitivity Emulsion 2 | N | 1.00 | | N | 1.12 | | N | 1.12 | |

| | | Sample 302 (Invention) | | | Sample 303 (Invention) | | | Sample 304 (Invention) | | |
|---|---|---|---|---|---|---|---|---|---|---|
| | | Emulsion | Size (μm) | $R_{2/1}$ | Emulsion | Size (μm) | $R_{2/1}$ | Emulsion | Size (μm) | $R_{2/1}$ |
| 4th Layer | Low-Sensitivity Emulsion 1 | A-e | 0.36 | 0.65 | A | 0.21 | 0.01 | A-d | 0.36 | 0.59 |
| | High-Sensitivity Emulsion 2 | B | 0.38 | | B | 0.38 | | B | 0.38 | |
| 5th Layer | Low-Sensitivity Emulsion 1 | B | 0.38 | 0.01 | B-b | 0.66 | 0.44 | B-b | 0.66 | 0.44 |
| | High-Sensitivity Emulsion 2 | C | 0.56 | | C | 0.56 | | C | 0.56 | |
| 9th Layer | Low-Sensitivity Emulsion 1 | E-e | 0.30 | | E | 0.15 | | E-d | 0.30 | |
| | Middle-Sensitivity Emulsion | F | 0.27 | 0.57 | F | 0.27 | 0.03 | F | 0.27 | 0.54 |
| | High-Sensitivity Emulsion 2 | G | 0.38 | | G | 0.38 | | G | 0.38 | |

TABLE 17-continued

| | | | | | | | | | | |
|---|---|---|---|---|---|---|---|---|---|---|
| 10th Layer | Low-Sensitivity Emulsion 1 | G | 0.38 | 0.01 | G-b | 0.55 | 0.38 | G-b | 0.55 | 0.38 |
| | High-Sensitivity Emulsion 2 | H | 0.56 | | H | 0.56 | | H | 0.56 | |
| 15th Layer | Low-Sensitivity Emulsion 1 | K-e | 0.53 | 0.69 | K | 0.31 | 0.00 | K-d | 0.53 | 0.61 |
| | High-Sensitivity Emulsion 2 | L | 0.49 | | L | 0.49 | | L | 0.49 | |
| 16th Layer | Low-Sensitivity Emulsion 1 | M | 0.66 | 0.04 | M-b | 1.14 | 0.41 | M-b | 1.14 | 0.41 |
| | High-Sensitivity Emulsion 2 | N | 1.12 | | N | 1.12 | | N | 1.12 | |

*$R_{2/1} = \log(S_2/S_1) - 2\log(X_2/X_1)$ $S_1$ and $S_2$: Sensitivities for Low-Sensitivity Emulsion 1 and High-Sensitivity Emulsion 2, respectively $X_1$ and $X_2$: Average grain sizes for Low-Sensitivity Emulsion 1 and High-Sensitivity Emulsion 2, respectively Specimens 301 to 304 thus prepared were then subjected to exposure and development in accordance with the foregoing method for determining the characteristic curve to obtain characteristic curves for R, G and B. From these characteristic curves, point gamma, Dmin, Dmax and the density for highlight areas ΔDa were obtained. The results are set forth in Table 18.

ΔDa: Value obtained by subtracting Dmin from the density at the point having a sensitivity of 0.6logE lower than the sensitivity point giving a density of 0.5

TABLE 18

| Specimen | | A value | Fluctuation coefficient (%) | B value | Fluctuation coefficient (%) | Dmin | Dmax | B/A | ΔDa | Remarks |
|---|---|---|---|---|---|---|---|---|---|---|
| | | | Point gamma (D = 0.5 to 1.5) | | (D = 1.5 to Dmax) | | | | | |
| 101 | B | 1.0 | 11.5 | 1.2 | 12.5 | 0.09 | 2.9 | 1.20 | 0.021 | Comparison |
| | G | 1.0 | 9.5 | 1.2 | 11.0 | 0.09 | 2.9 | 1.20 | 0.020 | |
| | R | 1.0 | 9.0 | 1.2 | 10.0 | 0.09 | 2.8 | 1.20 | 0.019 | |
| 111 | B | 1.0 | 11.4 | 1.2 | 12.3 | 0.09 | 3.3 | 1.20 | 0.019 | Invention |
| | G | 1.0 | 9.6 | 1.2 | 10.9 | 0.09 | 3.3 | 1.20 | 0.018 | |
| | R | 1.0 | 9.1 | 1.2 | 10.3 | 0.09 | 3.2 | 1.20 | 0.016 | |
| 301 | B | 1.0 | 10.1 | 1.2 | 12.1 | 0.09 | 3.3 | 1.20 | 0.012 | " |
| | G | 1.0 | 9.3 | 1.2 | 10.7 | 0.09 | 3.3 | 1.20 | 0.010 | |
| | R | 1.0 | 8.7 | 1.2 | 10.2 | 0.09 | 3.1 | 1.20 | 0.010 | |
| 302 | B | 1.0 | 9.6 | 1.2 | 12.1 | 0.09 | 3.3 | 1.20 | 0.005 | " |
| | G | 1.0 | 9.1 | 1.2 | 10.8 | 0.09 | 3.3 | 1.20 | 0.005 | |
| | R | 1.0 | 8.5 | 1.2 | 10.1 | 0.09 | 3.2 | 1.20 | 0.004 | |
| 303 | B | 1.0 | 10.8 | 1.2 | 10.1 | 0.09 | 3.3 | 1.20 | 0.013 | " |
| | G | 1.0 | 9.5 | 1.2 | 9.7 | 0.09 | 3.3 | 1.20 | 0.010 | |
| | R | 1.0 | 9.1 | 1.2 | 9.1 | 0.09 | 3.1 | 1.20 | 0.010 | |
| 304 | B | 1.0 | 9.9 | 1.2 | 9.9 | 0.09 | 3.3 | 1.20 | 0.007 | " |
| | G | 1.0 | 9.1 | 1.2 | 9.6 | 0.09 | 3.3 | 1.20 | 0.005 | |
| | R | 1.0 | 8.7 | 1.2 | 8.9 | 0.09 | 3.2 | 1.20 | 0.005 | |

Table 18 shows that Specimens 301 to 304 are excellent in variation coefficient and exhibit a steep toe in the highlight area on the characteristic curve.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having coated thereon at least one blue-sensitive silver halide emulsion layer containing a yellow coupler, one green-sensitive silver halide emulsion layer containing a magenta coupler and one red-sensitive silver halide emulsion layer containing a cyan coupler, wherein on each of the characteristic curves of yellow, magenta and cyan of said silver halide photographic material, 1) the average value of point gamma at various points in the exposure region corresponding to a density value of from not less than 0.5 to less than 1.5 is from not less than 0.85 to not more than 1.15 and the fluctuation width thereof is within ±15% of the average value of point gamma in said exposure region, 2) the average value of point gamma at various points in the exposure region corresponding to a density value of from not less than 1.5 to that 0.3 less than the maximum density is from not less than 1.0 to not more than 1.6 and the fluctuation width thereof is within ±15% of the average value of point gamma in said exposure region, and 3) wherein the average value of point gamma at various points in an exposure region having a density of from not less than 1.5 to that 0.3 less than the maximum density is from not less than 1.1 times to not more than 1.4 times the average value of point gamma at various points in an exposure region having a density of from not less than 0.5 to less than 1.5, and there are contained in at least one silver halide emulsion layer belonging to at least one color-sensitive layer two silver halide emulsions having the relationship between the average grain diameter and the sensitivity represented by the following inequality:

$$0.3 \leqq log(S1/S2) - 2log(X1/X2) \leqq 2.0$$

wherein S1 and S2 represent the sensitivity of Emulsion 1 and Emulsion 2 as calculated in terms of the reciprocal of exposure, respectively; and X1 and X2 represent the average grain diameter of Emulsion 1 and Emulsion 2, respectively.

2. The silver halide photographic material as claimed in claim 1, wherein in the silver halide emulsion layer having said two silver halide emulsions, one of said two silver halide emulsions has a lower sensitivity than the other, and a rhodium salt is added during the formation of grains for said silver halide emulsion having the lower sensitivity.

3. The silver halide photographic material as claimed in claim 1, wherein the material transmits light.

4. The silver halide photographic material as claimed in claim 1, which is processed with a developer containing a thiocyanate.

5. The silver halide photographic material as claimed in claim 1, wherein the material is a color reversal photographic material.

* * * * *